US011060741B2

(12) United States Patent
Ouchi et al.

(10) Patent No.: US 11,060,741 B2
(45) Date of Patent: Jul. 13, 2021

(54) HEAT SOURCE SYSTEM AND CONTROL METHOD THEREFOR

(71) Applicant: MITSUBISHI HEAVY INDUSTRIES THERMAL SYSTEMS, LTD., Tokyo (JP)

(72) Inventors: Toshiaki Ouchi, Tokyo (JP); Minoru Matsuo, Tokyo (JP); Koki Tateishi, Tokyo (JP); Satoshi Nikaido, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 16/699,219

(22) Filed: Nov. 29, 2019

(65) Prior Publication Data

US 2020/0158356 A1 May 21, 2020

Related U.S. Application Data

(62) Division of application No. 14/429,271, filed as application No. PCT/JP2013/075358 on Sep. 19, 2013, now abandoned.

(30) Foreign Application Priority Data

Sep. 21, 2012 (JP) ..... JP2012-208957
Feb. 28, 2013 (JP) ..... JP2013-038957

(51) Int. Cl.
*F24F 3/06* (2006.01)
*F24F 11/83* (2018.01)

(52) U.S. Cl.
CPC ..... *F24F 3/06* (2013.01); *F24F 11/83* (2018.01)

(58) Field of Classification Search
CPC ..... F24F 3/06; F24F 11/83
See application file for complete search history.

(56) References Cited

U.S. PATENT DOCUMENTS 3,815,813 A 6/1974 Charron
6,085,532 A 7/2000 Sibik
(Continued)

FOREIGN PATENT DOCUMENTS

CN 1490571 A 4/2004
JP 10-213339 A 8/1998
(Continued)

OTHER PUBLICATIONS

Translation of JP2004278884A (Year: 2004).*
(Continued)

*Primary Examiner* — Marc E Norman
*Assistant Examiner* — Schyler S Sanks
(74) *Attorney, Agent, or Firm* — Birch, Stewart, Kolasch & Birch, LLP

(57) ABSTRACT

The purpose of the present invention is to maintain a water supply temperature close to a target water supply temperature at the time of a change in the number of heat source machines operating. A heat source system of the present invention anticipates a case where a prescribed minimum flow rate is set for heat source machines that are subject to addition or removal, and calculates, as compensation temperatures, hot and cold water outlet temperatures of the heat source machines so that the water supply temperature in such a case will match a target water supply temperature, and changes the hot and cold water outlet temperature settings of the operating heat source machines to the compensation temperatures. After that, the heat source machines that are subject to addition or removal are either started up or stopped, and the set flow rate for the heat source machines
(Continued)

that are subject to addition or removal is set to the minimum flow rate.

19 Claims, 18 Drawing Sheets

(56) References Cited

U.S. PATENT DOCUMENTS

| | | | | |
|---|---|---|---|---|
| 2004/0176858 | A1 | 9/2004 | Kuwahara et al. | |
| 2010/0180629 | A1* | 7/2010 | Ueda | F25D 17/02 62/498 |
| 2012/0174609 | A1* | 7/2012 | Matsuo | F24F 11/30 62/190 |
| 2012/0174809 | A1 | 7/2012 | Matsuo et al. | |

FOREIGN PATENT DOCUMENTS

| | | | |
|---|---|---|---|
| JP | 10-238842 | A | 9/1998 |
| JP | 3354891 | B2 | 9/2002 |
| JP | 2003-294290 | A | 10/2003 |
| JP | 2004-278884 | A | 10/2004 |
| JP | 2004-278885 | A | 10/2004 |
| JP | 2004278884 | A * | 10/2004 |
| JP | 2005-114295 | A | 4/2005 |
| JP | 2006-153324 | A | 6/2006 |
| JP | 2009-36494 | A | 2/2009 |
| JP | 2010-255984 | A | 11/2010 |
| PK | 3815813 | A | 6/1974 |

OTHER PUBLICATIONS

Extended European Search Report dated Jun. 2, 2016 in corresponding European Application No. 13839153.7.

International Search Report dated Dec. 24, 2013 for International Patent Application No. PCT/JP2013/075358 with an English translation.

Japanese Decision to Grant a Patent, dated Jan. 31, 2017, for Japanese Application No. 2013-038957.

Office Action dated Oct. 28, 2016 in corresponding Chinese Application No. 201380047544.7 with an English Translation.

Written Opinion dated Dec. 24, 2013 in International Application No. PCT/JP2013/075358.

* cited by examiner

HEAT SOURCE SYSTEM AND CONTROL METHOD THEREFOR

This application is a Divisional of copending application Ser. No. 14/429,271, filed on Mar. 18, 2015, which is the National Phase under 35 U.S.C, § 371 of International Application No. PCT/JP2013/075358, filed on Sep. 19, 2013, which claims the benefit under 35 U.S.C. § 119(a) to Patent Application Nos. 2012-208957 and 2013-038957, filed in Japan on Sep. 21, 2012 and Feb. 28, 2013, all of which are hereby expressly incorporated by reference into the present application.

TECHNICAL FIELD

The present invention relates to a heat source system and a control method thereof.

BACKGROUND ART

In the related art, a heat source system is known in which plural heat source machines are connected in parallel (for example, see PTL 1), In such a heat source system, the heat source machines are generally operated such that the temperature of cold/hot water (hereinafter, referred to as "supply water temperature") sent out from the heat source machine side to a load side becomes equal to a target supply water temperature (for example, 7° C.) set by a load-side request.

In operation, when the number of heat source machines operating increases and a stopped heat source machine is started, time is required until the capability of the heat source machine is exercised. Accordingly, the supply water temperature temporarily has a value separated from the target supply water temperature and cold/hot water cannot be stably supplied to the load side.

In the related art, the following solution has been proposed for such a problem.

For example, PTL 1 discloses a method of suppressing a rise in supply water temperature by setting the set value of a cold/hot water outlet temperature of a refrigerator to be lower than a currently-set value and a method of causing the supply water temperature to approach a target temperature by setting the flow rate of a refrigerator in operation to be greater than an anticipated flow rate at the time of adding or subtracting a refrigerator.

PTL 2 discloses that a supply water temperature is prevented from being separated from a target temperature by changing the set value of an outlet temperature of a heat source machine when the number of pumps operating is different from the number of refrigerators operating.

CITATION LIST

Patent Literature

[PTL 1] Japanese Unexamined Patent Application Publication No. 2005-114295

[PTL 2] Japanese Unexamined Patent Application Publication No. 2004-278884

SUMMARY OF INVENTION

Technical Problem

However, in the method disclosed in PTL 1, when the set value of the cold/hot water outlet temperature of the heat source machine is excessively lowered, the supply water temperature is also excessively lowered and there is a possibility that the supply water temperature will be separated from a target supply water temperature. On the contrary, when the set value is insufficiently lowered, the rise in the supply water temperature can be suppressed in comparison with a case in which the set value is not changed, but there is a possibility that the supply water temperature will be much higher than the target supply water temperature requested by the load side in this case.

As disclosed in PTL 1, when the flow rate of a refrigerator in operation is set to be higher than an anticipated flow rate, it is possible to suppress the rise in the supply water temperature. However, when the cold water outlet setting temperature of the refrigerator is not lowered, the supply water temperature generally becomes higher than the target supply water temperature. In order to avoid this problem, when the cold water outlet setting temperature of the refrigerator is lowered as described above, there is a possibility that the supply water temperature will be excessively lowered depending on the degree of lowering.

In the method disclosed in PTL 2, there is a possibility that the supply water temperature will be separated from the target temperature until the outlet temperature of the refrigerator reaches the changed setting temperature.

The present invention is made in consideration of the aforementioned circumstances and an object thereof is to provide a heat source system that can keep a supply water temperature in the vicinity of a target supply water temperature when changing the number of heat source machines operating and a control method thereof.

Solution to Problem

According to a first aspect of the present invention, there is provided a heat source system that includes a plurality of heat source machines connected in parallel to a load and that controls operations of the heat source machines such that a supply water temperature of cold/hot water which is supplied to the load corresponds to a target supply water temperature which is determined by a load-side request, the heat source system including: temperature calculating means for anticipating a case in which a predetermined flow rate is set for the heat source machine to be added or subtracted when changing the number of heat source machines operating and calculating a cold/hot water outlet temperature of the heat source machine in operation as a compensation temperature such that the supply water temperature at that time corresponds to the target supply water temperature; and temperature setting means for changing a cold/hot water outlet setting temperature of the heat source machine in operation to the compensation temperature, wherein the heat source machine to be added or subtracted is started or stopped and the setting flow rate of the heat source machine to be added or subtracted is set to the predetermined flow rate, after the supply water temperature is changed with the changing of the cold/hot water outlet setting temperature of the heat source machine in operation.

According to this aspect, when changing the number of heat source machines operating, the change in the supply water temperature when a heat source machine is added or subtracted is predicted in advance, the cold/hot water outlet temperature of the heat source machine of which the supply water temperature reaches the target supply water temperature is calculated as the compensation temperature, and the compensation temperature is set as the cold/hot water outlet setting temperature of the heat source machine in operation. Accordingly, for example, when a heat source machine is added, the capability shortfall in a period until the capability is exercised after the heat source machine to be additionally started is started can be supplemented with the heat source machines in operation. When a heat source machine is subtracted, the capability shortfall can be supplemented with the heat source machines operating even in a state in which the heat source machine to be stopped does not exercise its capability. As a result, it is possible to prevent the supply water temperature from being separated from the target supply water temperature when a heat source machine is actually added or subtracted and it is possible to supply cold/hot water, of which the temperature is stabilized, to an external load even when changing the number of heat source machines operating.

The expression, "after the supply water temperature is changed with the change in the cold/hot water outlet setting temperature of the heat source machines in operation", means after a predetermined amount of time elapses after the cold/hot water outlet setting temperature of the heat source machines is changed to the compensation temperature or after the supply water temperature or the cold/hot water outlet temperatures of the heat source machines enter the allowable temperature range set to be close to the compensation temperature. The "predetermined amount of time" is empirically set on the basis of the amount of time required until the supply water temperature or the cold/hot water outlet temperatures of the heat source machines enter the allowable temperature range set to be close to the compensation temperature.

In the heat source system, the temperature calculating means may calculate the compensation temperature, for example, using an operational expression including the cold/hot water outlet temperature of the heat source machine to be added or subtracted, the flow rate of cold/hot water flowing in the heat source machine to be added or subtracted, and the flow rate of cold/hot water in the heat source machine which has already operated and which continuously operates after the addition or subtraction as parameters.

In the heat source system, the cold/hot water outlet temperatures of all the heat source machines in operation may be set to the target supply water temperature at the time of adding the heat source machine when the heat source machine to be added is started and it is determined that the cold/hot water outlet temperature of the heat source machine to be added is in an allowable temperature range set to be close to the target supply water temperature.

The expression, "when it is determined that the cold/hot water outlet temperature of the heat source is in the allowable temperature range set to be close to the target supply water temperature", means that, for example, when a predetermined amount of time elapses after the heat source machine is started as well as when the cold/hot water outlet temperature of the heat source machine enters the allowable temperature range, the cold/hot water outlet temperature of the heat source machine is considered to be in the allowable temperature range. In this case, the cold/hot water outlet setting temperature may be changed.

In the heat source system, the cold/hot water outlet setting temperatures of all the heat source machines in operation may be set to the target supply water temperature in subtracting the heat source machine when the heat source machine to be subtracted is started and a predetermined amount of time elapses after the heat source is subtracted or water supply means provided to correspond to the heat source machine to be subtracted is stopped.

In the heat source system, the temperature calculating means may set the compensation temperature to a predetermined temperature upper limit set in advance on the basis of capability of the heat source machine when the compensation temperature is higher than the temperature upper limit.

In the heat source system, the temperature calculating means may set the compensation temperature to a predetermined temperature lower limit set in advance on the basis of capability of the heat source machine when the compensation temperature is lower than the temperature lower limit.

By employing this configuration, it is possible to avoid separation of the supply water temperature from the target supply water temperature and to prevent a trip of the heat source machine in operation.

In the heat source system, the temperature calculating means may calculate the compensation temperature using the flow rate of the heat source in operation as a maximum flow rate, and the cold/hot water outlet setting temperature of the heat source in operation may be changed to the compensation temperature and the setting flow rate thereof is changed to the maximum flow rate.

According to this heat source system, it is possible to broaden the control width of the supply water temperature by additionally performing the flow rate control in addition to the temperature control, and it is possible to cause the heat source machine in operation to further exercise its capability. Accordingly, it is possible to supplement the capability shortfall when the heat source machine to be added or subtracted is additionally started or stopped with the heat source machines in operation as much as possible and it is possible to further suppress the variation in the supply water temperature when changing the number of heat source machines operating.

In the heat source system, the temperature recalculating means may calculate the compensation temperature using the flow rate of the heat source machine in operation as a maximum flow rate when the compensation temperature departs from a predetermined temperature upper-lower limit range set in advance on the basis of capability of the heat source machine, and the cold/hot water outlet setting temperature of the heat source machine in operation may be set to the recalculated compensation temperature and the setting flow rate is set to the maximum flow rate.

By employing this configuration, the flow rate can be adjusted only in a situation which cannot be coped with by only changing the temperature, and it is thus possible to skip unnecessary flow rate adjustment.

In the heat source system, it may be determined whether an operation state of the heat source machine in operation reaches a capability upper limit after the cold/hot water outlet setting temperature of the heat source machine in operation is set to the compensation temperature by the temperature setting means at the time of adding the heat source machine, and the heat source machine to be added may be immediately started when the operation state of the heat source machine reaches the capability upper limit.

According to this heat source system, when the capability of the heat source machine continuously operating reaches the upper limit, it is possible to skip an unnecessary determination process and to rapidly start the heat source machine to be added.

The heat source system may further include temperature measuring means for measuring a return water temperature from the load, and the temperature calculating means may calculate the compensation temperature using the return water temperature measured by the temperature measuring means as the cold/hot water outlet temperature of the heat source machine to be added or subtracted.

Accordingly, it is possible to easily calculate the compensation temperature.

In the heat source system, the temperature calculating means may calculate a theoretical value of the return water temperature on the basis of a relationship among a heat source load, a heat quantity of cold/hot water sent out from the system to the external load, and a heat quantity of cold/hot water flowing into the system, and may calculate the compensation temperature using theoretical value of the return water temperature as the cold/hot water outlet temperature of the heat source machine to be added or subtracted.

In this way, it is possible to improve the estimation accuracy of the cold/hot water outlet temperature of the heat source machine to be added or subtracted by using theoretical value of the return water temperature as the cold/hot water outlet temperature of the heat source machine to be added or subtracted at the time of calculating the compensation temperature. Accordingly, it is possible to improve the calculation accuracy of the compensation temperature and to bring the supply water temperature closer to the target supply water temperature when changing the number of heat source machines.

The heat source system may further include temperature measuring means for measuring a return water temperature from the load, and the temperature calculating means may calculate a theoretical value of the return water temperature on the basis of a relationship among a heat source load, a heat quantity of cold/hot water sent out from the system to the external load, and a heat quantity of cold/hot water flowing into the system and may calculate the compensation temperature using the return water temperature, which is calculated using both the measured value of the return water temperature measured by the temperature measuring means and the theoretical value of the return water temperature as parameters, as the cold/hot water outlet temperature of the heat source machine to be added or subtracted.

For example, when only the measured value of the return water temperature is used, the compensation temperature at the current time is calculated. On the other hand, when theoretical value is used, the compensation temperature in a future situation is calculated. For example, when a heat source machine is added or subtracted, the measured value is changed to correspond to theoretical value, the change in the compensation temperature becomes slower when the measured value is slowly changed, and the heat source machines can track the change in the compensation temperature. However, when the compensation temperature is calculated using the measured value of the return water temperature as the cold/hot water outlet temperature of the heat source machine to be added or subtracted and the return water temperature is rapidly changed, the compensation temperature is accordingly rapidly changed. Then, there is a possibility that the heat source machines will not track the change in the compensation temperature and the supply water temperature will be separated from the target supply water temperature. Accordingly, by calculating the return water temperature using both theoretical value and the measured value as parameters in consideration of such a situation and considering the return water temperature as the cold/hot water outlet temperature of the heat source machine to be added, it is possible to prevent the supply water temperature from being separated from the target supply water temperature.

In the heat source system, the temperature calculating means may calculate the compensation temperature using a correction value obtained by multiplying a predetermined coefficient equal to or greater than zero and equal to or less than 1 by a value, which is obtained by subtracting theoretical value of the return water temperature from the measured value of the return water temperature measured by the temperature measuring means.

In this way, by calculating the compensation temperature using the correction value based on the difference between theoretical value and the measured value of the return water temperature, it is possible to bring the supply water temperature close to the target supply water temperature even when the return water temperature departs from theoretical value thereof.

In the heat source system, a change rate may be set to be lower than a predetermined change rate set on the basis of tracking capability of the heat source machine in operation when increasing the cold/hot water flow rate of the heat source machine to be added.

According to this heat source system, even when the cold/hot water flow rate of the heat source machine to be added increases, the change in the supply water temperature due to the increase in the flow rate is absorbed by capability of the heat source machines in operation and it is thus possible to keep the supply water temperature close to the target supply water temperature.

In the heat source system, the cold/hot water outlet setting temperature of the heat source machine to be subtracted may be changed to a predetermined temperature set in advance at a predetermined change rate to lower the load of the heat source machine to be subtracted when subtracting the heat source machine, an operation stop instruction may be given to the heat source machine to be subtracted, and the cold/hot water outlet setting temperature of the heat source in operation may be changed to the target supply water temperature.

According to this heat source system, by changing the cold/hot water outlet temperature of the heat source machine to be subtracted to a predetermined temperature set in advance at a predetermined change rate, the load of the heat source machine to be subtracted is intentionally slowly lowered, then the corresponding heat source machine is stopped, and the cold/hot water outlet temperature of the heat source machines in operation is changed to the target supply water temperature. Accordingly, it is possible to absorb the change in the supply water temperature at the time of subtracting a heat source machine by causing the heat source machines in operation to exercise their capability and to keep the supply water temperature close to the target supply water temperature.

In the heat source system, the change rate may be set to a change rate in a range in which an overshoot or an undershoot of the cold/hot water outlet temperature with respect to the cold/hot water outlet setting temperature of the heat source machine in operation does not occur when changing the cold/hot water outlet setting temperature of the heat source machine in operation from the compensation temperature to the target supply water temperature.

Accordingly, it is possible to suppress separation of the supply water temperature from the target supply water temperature, which occurs when changing the cold/hot water outlet setting temperature of the heat source machine in operation from the compensation temperature to the target supply water temperature.

In the heat source system, the compensation temperature may be recalculated so as to distribute a heat quantity shortfall of the heat source machines to the other heat source machines in operation of which the capability does not reach the capability upper limit and the cold/hot water outlet setting temperature of the other heat source machines in operation of which the capability does not reach the capability upper limit may be set to the recalculated compensation temperature when the operation states of some heat source machines in operation reach the capability upper limit and the cold/hot water outlet temperature of the heat source machines in operation does not reach the compensation temperature after the cold/hot water outlet setting temperature of at least the heat source machines in operation is set to the compensation temperature by the temperature setting means.

By employing this configuration, when the cold/hot water outlet setting temperature of a heat source machine in operation is changed to the compensation temperature and there is a heat source machine that cannot track the compensation temperature due to the capability shortfall thereof, it is possible to supplement the capability shortfall with the other heat source machines in operation which does not reach the capability upper limit. Accordingly, it is possible to effectively use the capability of the heat source machines in operation.

In the heat source system, the temperature calculating means may calculate the compensation temperature using the cold/hot water outlet temperature of the heat source machines, or the lower temperature of the cold/hot water outlet temperature and the return water temperature when cooling a heat medium, or the higher temperature of the cold/hot water outlet temperature and the return water temperature when heating the heat medium as the cold/hot water outlet temperature of the heat source machine to be added after the heat source machine to be added is started.

Accordingly, after the heat source machine to be added is started, it is possible to calculate the compensation temperature of the heat source machines in operation in consideration of the temperature change of the cold/hot water outlet temperature of the heat source machine to be added. As a result, it is possible to control the supply water temperature so as to be close to the target supply water temperature while the heat source machine to be added gradually exercises its capability.

The heat source system may further include temperature measuring means for measuring a cold/hot water outlet temperature or a cold/hot water inlet temperature of the heat source machine, and the temperature calculating means may calculate the compensation temperature using the measured value, which has been measured by the temperature measuring means provided to correspond to the heat source machine to be added or subtracted, as the cold/hot water outlet temperature of the heat source machine to be added or subtracted.

In this way, since the cold/hot water outlet temperature or the cold/hot water inlet temperature of the heat source machine to be added or subtracted is measured by the temperature measuring means and the compensation temperature is calculated using the measured value, it is possible to improve the accuracy of the compensation temperature.

In the heat source system, the predetermined flow rate of the heat source machine to be added may be set within a range equal to or higher than a minimum flow rate of a cold/hot water pump provided to correspond to the heat source machine to be added and equal to or lower than a minimum flow rate determined on the basis of a specification of the heat source machine to be added.

Accordingly, it is possible to supply the cold/hot water of the heat source machine to be added at a low flow rate and thus to reduce the influence which the temperature of the cold/hot water in the heat source machine to be added gives to the supply water temperature. Accordingly, for example, even when the temperature of the cold/hot water in the heat source machine to be added is separated from the return water temperature, it is possible to prevent the supply water temperature from being greatly separated from the target supply water temperature.

In the heat source system, the predetermined flow rate of the heat source machine to be subtracted may be set to a minimum flow rate determined on the basis of a specification of the heat source machine to be subtracted.

In this way, by setting the predetermined flow rate to the minimum flow rate determined on the basis of the specification of the heat source machine to be subtracted, it is possible to reduce the influence which the cold/hot water sent out from the heat source machine to be subtracted gives to the supply water temperature.

In the heat source system, the temperature calculating means may have a weighting set on the basis of an influence which the cold/hot water sent out from each heat source machine gives to the supply water temperature for each heat source machine and may calculate the compensation temperature using the weighting.

In this way, since each heat source machine has a weighting set on the basis of the influence which the cold/hot water sent out from the heat source machine gives to the supply water temperature and the compensation temperature is calculated using the weighting, it is possible to improve the calculation accuracy of the compensation temperature.

According to a second aspect of the present invention, there is provided a control method of a heat source system that includes a plurality of heat source machines connected in parallel to a load and that controls operations of the heat source machines such that a supply water temperature of cold/hot water which is supplied to the load corresponds to a target supply water temperature which is determined by a load-side request, the control method including: a step of anticipating a case in which a predetermined flow rate is set for the heat source machine to be added or subtracted when changing the number of heat source machines operating and calculating a cold/hot water outlet temperature of the heat source machine in operation as a compensation temperature such that the supply water temperature at that time corresponds to the target supply water temperature; and a step of changing a cold/hot water outlet setting temperature of the heat source machine in operation to the compensation temperature, wherein the heat source machine to be added or subtracted is started or stopped and the setting flow rate of the heat source machine to be added or subtracted is set to the predetermined setting flow rate, after the supply water temperature is changed with the changing of the cold/hot water outlet setting temperature of the heat source machine in operation.

Advantageous Effects of Invention

According to the present invention, it is possible to keep the supply water temperature in the vicinity of the target supply water temperature.

DESCRIPTION OF EMBODIMENTS

First Embodiment

Hereinafter, a heat source system and a control method thereof according to a first embodiment of the present invention will be described with reference to the accompanying drawings.

Figure 1:
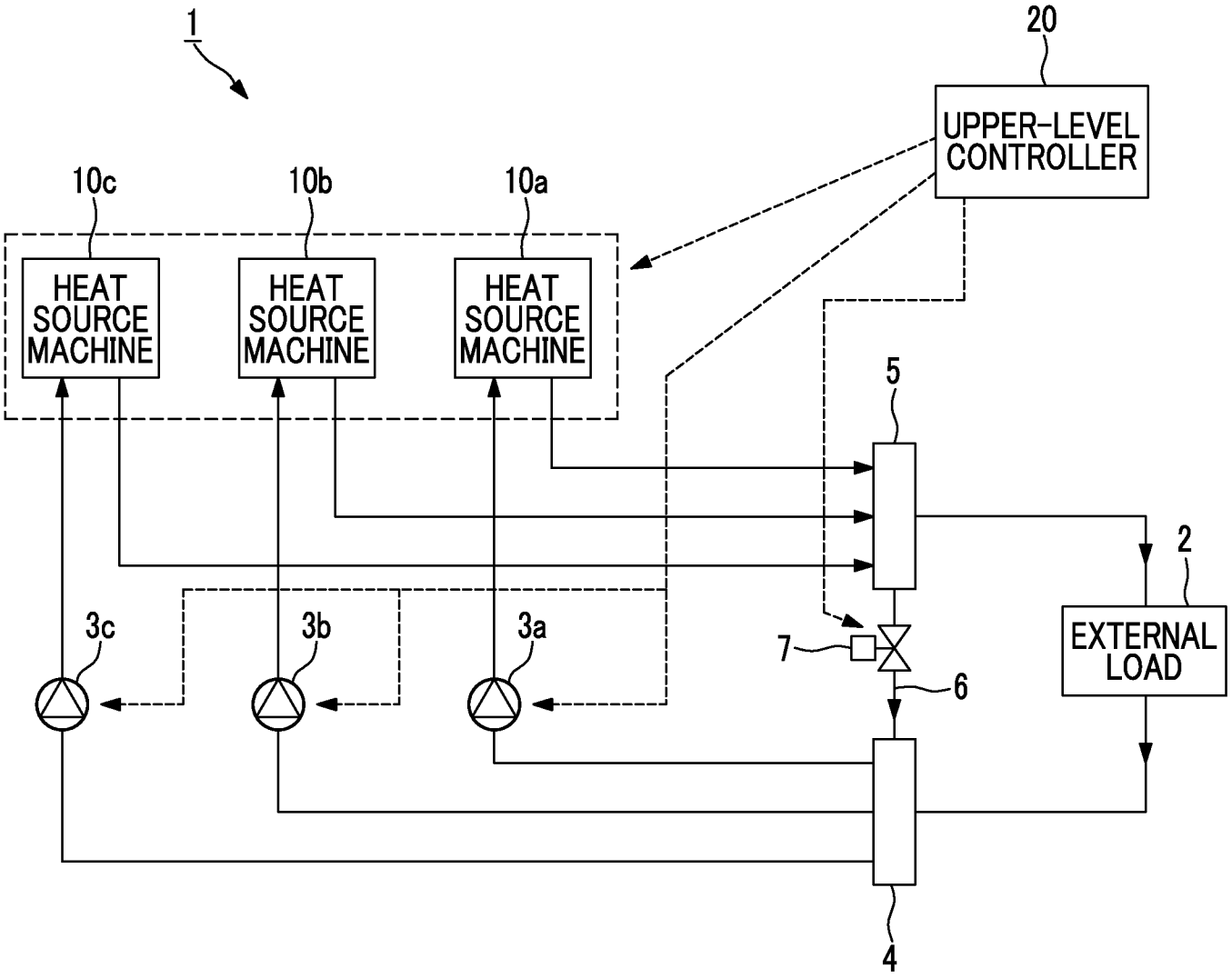
FIG. 1 is a diagram schematically illustrating a configuration of a heat source system according to a first embodiment of the present invention.

FIG. 1 is a diagram schematically illustrating a configuration of a heat source system according to the first embodiment of the present invention. A heat source system 1 includes plural heat source machines 10*a*, 10*b*, and 10*c* that cool a heat medium (cold water) to be supplied to an external load 2 such as an air conditioner, a water heater, and a plant facility. The heat source machines 10*a*, 10*b*, and 10*c* are connected in parallel to the external load 2. In FIG. 1, three heat source machines 10*a*, 10*b*, and 10*c* are provided, but the number of heat source machines installed can be arbitrarily determined.

Cold/hot water pumps 3*a*, 3*b*, and 3*c* pumping heat mediums are disposed on the upstream side of the heat source machines 10*a*, 10*b*, and 10*c* in the heat medium flow. Heat mediums from the return head 4 are supplied to the heat source machines 10*a*, 10*b*, and 10*c* by the cold/hot water pumps 3*a*, 3*b*, and 3*c*. The cold/hot water pumps 3*a*, 3*b*, and 3*c* are driven by an inverter motor (not illustrated) and thus the flow rates thereof are controlled to be variable by varying the rotation speed.

The heat mediums cooled or heated by the heat source machines 10*a*, 10*b*, and 10*c* gather in a supply header 5. The heat mediums gathering in the supply header 5 is supplied to the external load 2. The heat mediums which have been provided to air-conditioning in the external load 2 and of which the temperature has risen or fallen are sent to the return header 4. The heat mediums are branched in the return header 4 and are sent again to the heat source machines 10*a*, 10*b*, and 10*c*.

A bypass pipe 6 is disposed between the supply header 5 and the return header 4. The bypass pipe 6 is provided with a bypass valve 7 for adjusting a bypass flow rate.

The heat source machines 10*a*, 10*b*, and 10*c* are connected to an upper-level controller 20 via a communication medium and both can interactively communicate.

The upper-level controller 20 is, for example, a controller that controls the heat source system as a whole and performs supply water temperature control of setting a cold/hot water outlet set temperatures of the heat source machines 10*a*, 10*b*, and 10*c* such that the supply water temperature of cold/hot water supplied to the external load 2 is equal to a target supply water temperature determined by a request of the external load 2, controlling of the number of heat source machines 10*a*, 10*b*, and 10*c* operating based on a request load of the external load 2, rotation speed control of the pumps 3*a*, 3*b*, and 3*c*, valve opening control of the bypass valve 7 based on the pressure difference between the supply header 5 and the return header 4, and the like.

The upper-level controller 20 is, for example, a computer and includes a central processing unit (CPU), a main storage device such as a random access memory (RAM), an auxiliary storage device, and a communication device that transmits and receives information by communication with an external device.

The auxiliary storage device is a computer-readable recording medium and examples thereof include a magnetic disk, a magneto-optical disk, a CD-ROM, a DVD-ROM, and a semiconductor memory. Various programs are stored in the auxiliary storage device and various processes are realized by causing the CPU to read the programs from the auxiliary storage device into the main storage device and to execute the read programs.

Figure 2:
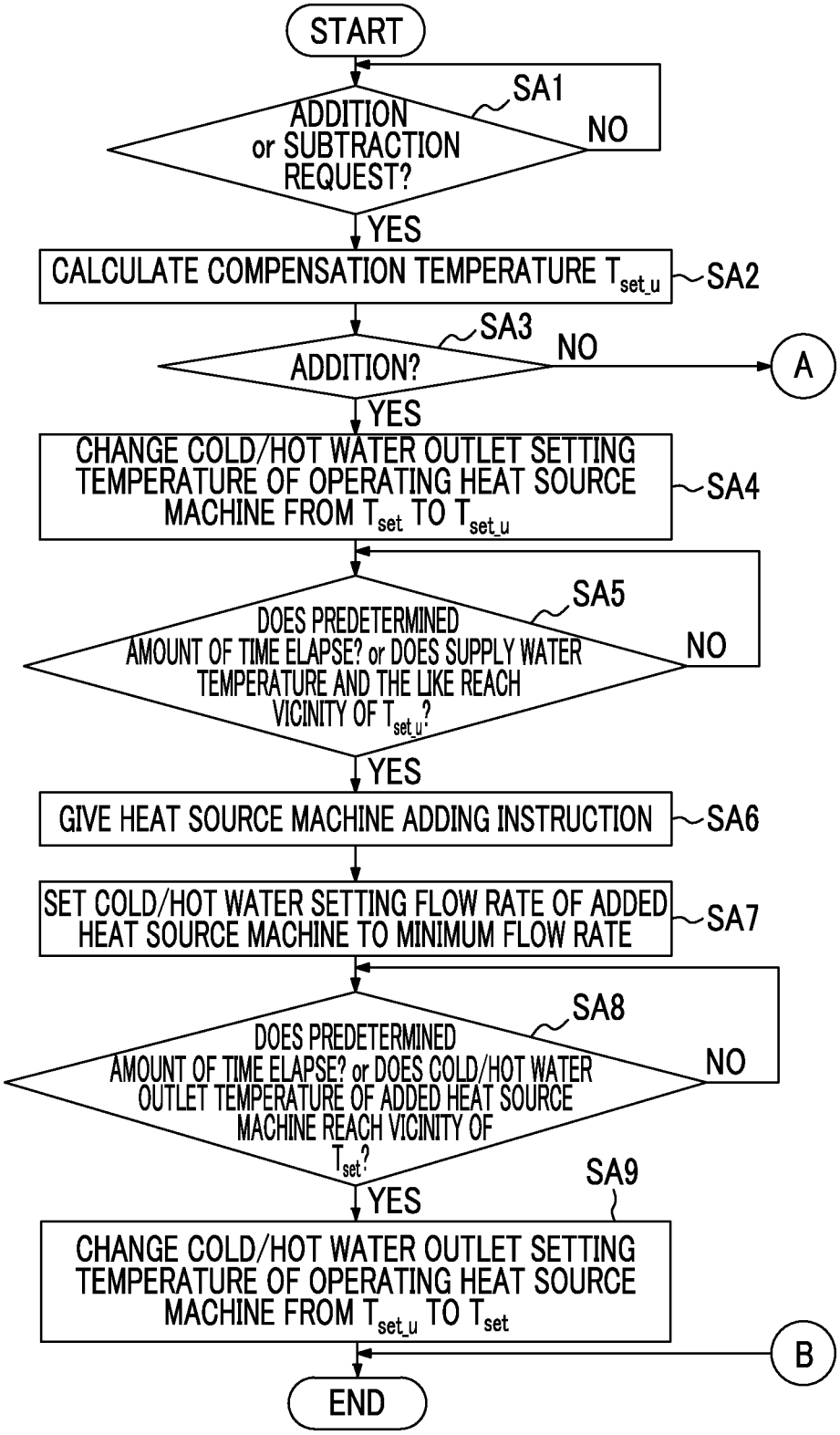
FIG. 2 is a flowchart illustrating a supply water temperature compensating process according to the first embodiment of the present invention.

FIG. 2 is a flowchart illustrating a supply water temperature compensating process which is performed at the time of changing the number of heat source machines operating in the supply water temperature control out of various control functions of the upper-level controller 20.

Figure 4:
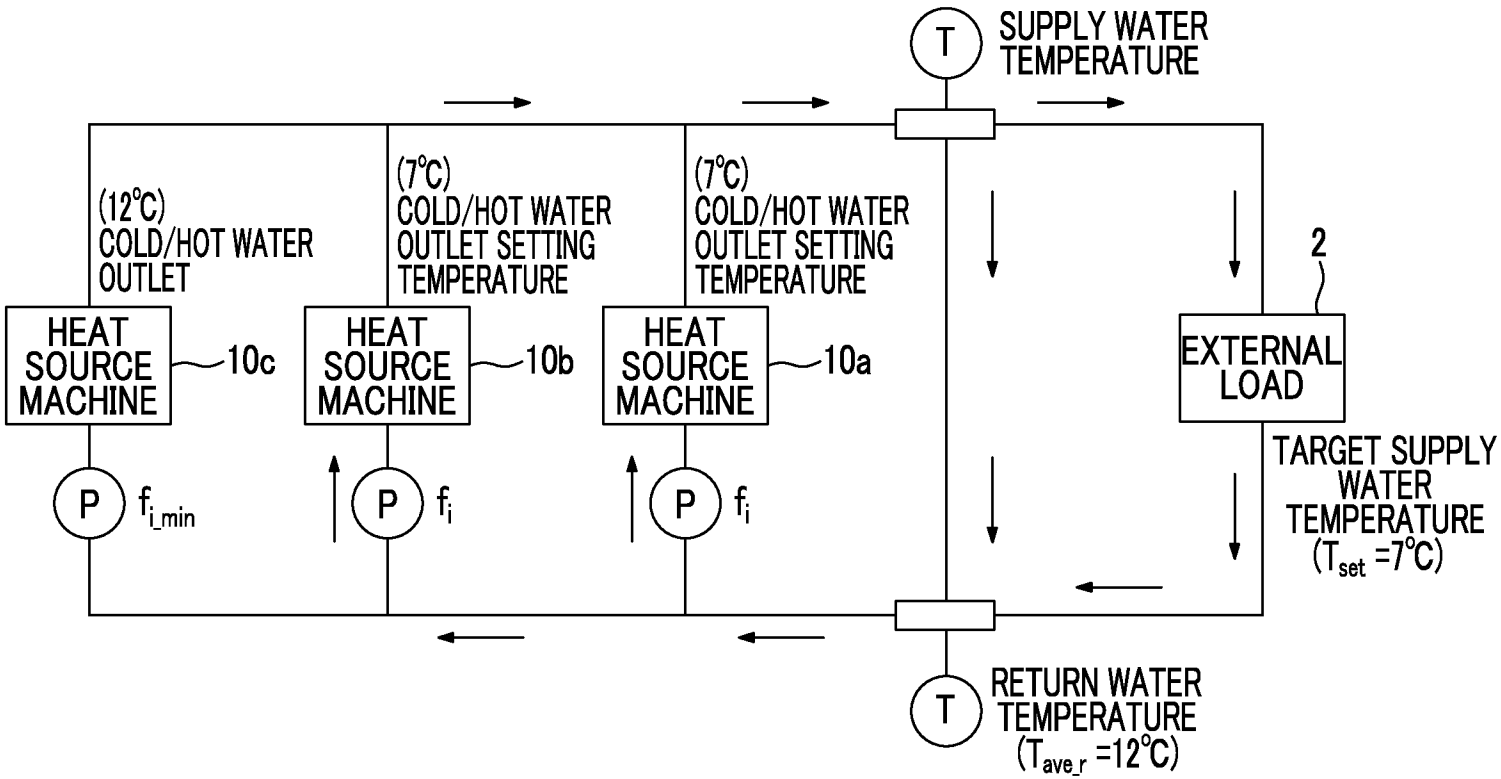
FIG. 4 is a diagram illustrating the supply water temperature compensating process illustrated in FIGS. 2 and 3.

For example, as illustrated in FIG. 4, when the heat source machines 10*a* and 10*b* operate already (hereinafter, a heat source machine operating already is referred to as an "operating heat source") and the target supply water temperature is set to 7° C., the cold/hot water outlet setting temperature of the heat source machines 10*a* and 10*b* is set to 7° C. which is equal to the target supply water temperature 7° C. In this state, when the heat source machine 10*c* is newly added, cold/hot water (for example, 12° C.) close to the return water temperature (the temperature of cold/hot water supplied from the return header 4 to the heat source machines) is output from the heat source machine 10*c* until the capability of the heat source machine 10*c* is exercised after it is started. Accordingly, when the operations of the heat source machines 10*a* and 10*b* are kept at the cold/hot water outlet setting temperature 7° C., the supply water temperature may be separated from 7° C. in a direction in which the temperature rises. This problem similarly occurs when the number of heat source machines decreases.

The supply water temperature compensating process is to suppress the separation of the supply water temperature from the target supply water temperature at the time of changing the number of heat source machines operating and is to keep the supply water temperature of cold/hot water close to the target supply water temperature at the time of changing the number of heat source machines operating.

The supply water temperature compensating process will be described below with reference to FIGS. 2 and 3.

First, when an addition or subtraction request is input ("YES" in step SA1), a case in which a predetermined minimum flow rate determined on the basis of the specification (capability) of the heat source machine is set for a heat source machine to be added or subtracted is anticipated, and the cold/hot water outlet temperature of the heat source machine is calculated as the compensation temperature $T_{set_u}$ such that the estimated supply water temperature at that time is equal to the target supply water temperature (temperature calculating means), Here, in this embodiment, the case in which a "predetermined minimum flow rate" is set for the heat source machine to be added or subtracted is anticipated, but the anticipated flow rate is not necessarily the minimum flow rate determined on the basis of the specification of the heat source machine.

Specifically, the compensation temperature $T_{set_u}$ is calculated using Expression (2) (step SA2).

Figure 3:
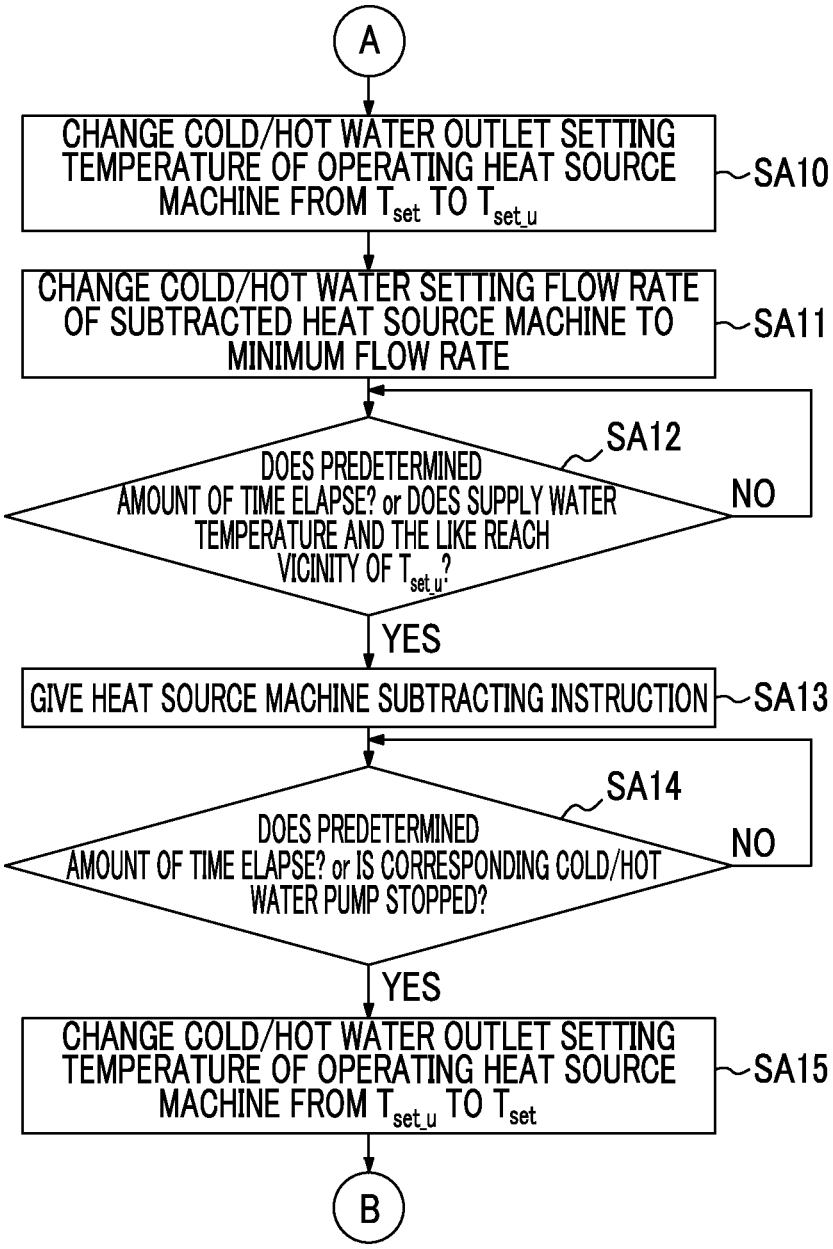
FIG. 3 is a flowchart illustrating the supply water temperature compensating process according to the first embodiment of the present invention.

For example, in the heat source system illustrated in FIG. 3, when a case in which the heat source machine 10*c* is newly started and a heat medium flows in the heat source machine 10*c* at a minimum flow rate $f_{n_min}$, Expression (1) needs to be established in order to make the supply water temperature before the heat source machine 10*c* exercises its capability equal to the target supply water temperature.

$$T_{set_u} \times \sum_{i=1}^{n-1} f_i + t_{ave_r} \times f_{n_minn} = T_{set} \times \left( \sum_{i=1}^{n-1} f_i + f_{n_min} \right) \tag{1}$$

In Expression (1), $T_{set}$ represents the target supply water temperature, $f_i$ represents the flow rate of cold/hot water flowing in an operating heat source machine, $T_{set_u}$ represents a cold/hot water outlet setting temperature (=compensation temperature) of an operating heat source machine, and $t_{ave_r}$ represents the return water temperature, which employs a time average of the measured temperature values measured by a temperature sensor (temperature measuring means) disposed in the vicinity of the return header 4. The cold/hot water outlet setting temperature $T_{set_u}$ of an operating heat source machine for establishing Expression (1) is given by Expression (2).

$$T_{set_u} = \frac{T_{set}\left( \sum_{i=1}^{n-1} f_i + f_{n_min} \right) - f_{n_min} \times t_{ave_r}}{\sum_{i=1}^{n-1} f_i} \tag{2}$$

The compensation temperature $T_{set_u}$ is repeatedly calculated with a predetermined sampling cycle. Accordingly, the compensation temperature $T_{set_u}$ to be described later means the newest value at that time. This is true of the embodiments to be described later.

Then, it is determined whether a heat source machine is added (step SA3). When it is determined that a heat source machine is added ("YES" in step SA3), the cold/hot water outlet setting temperatures of the operating heat source machines are changed from the target supply water temperature $T_{set}$ to the compensation temperature $T_{set_u}$ (step SA4). Subsequently, it is determined whether a predetermined amount of time elapses after the cold/hot water outlet setting temperature of the heat source machine is changed to the compensation temperature or whether the supply water temperature or the cold/hot water outlet temperatures of the operating heat source machines are in an allowable range set to be close to the compensation temperature $T_{set_u}$ (step SA5). When it is determined that the predetermined amount of time elapses or that the supply water temperature or the cold/hot water outlet temperatures of the operating heat source machines are in the allowable range, a start instruction is output to the heat source machine to be added and the flow rate of cold/hot water flowing into the heat source machine is se to the minimum flow rate, that is, the flow rate anticipated at the time of calculating the compensation temperature $T_{set_u}$ (steps SA6 and SA7).

Then, it is determined whether a predetermined amount of time elapses after a heat source machine is started or whether the cold/hot water outlet temperature of the started heat source machine (hereinafter, referred to as "added heat source machine") is in an allowable range set to be close to the target supply water temperature $T_{set}$ (step SA8). When it is determined that the predetermined amount of time elapses or that the cold/hot water outlet temperatures are in the allowable range ("YES" in step SA8), the cold/hot water outlet setting temperature of the operating heat source machines are changed from the compensation temperature $T_{set_u}$ to the target supply water temperature $T_{set}$ (step SA9) and then the supply water temperature compensating process ends.

On the other hand, when it is determined in step SA3 that a heat source machine is added, the cold/hot water outlet setting temperatures of the operating heat source machines (which include the heat source machine to be subtracted) is changed from the target supply water temperature $T_{set}$ to the compensation temperature $T_{set_u}$, and the cold/hot water setting flow rate of the heat source machine to be subtracted (hereinafter, referred to as "subtracted heat source machine") is changed to the minimum flow rate (steps SA10 and SA11 in FIG. 3). In step SA10, instead of the operating heat source machines, the cold/hot water outlet setting temperatures of the operating heat source machines except the heat source machine to be subtracted may be changed from the target supply water temperature $T_{set}$ to the compensation temperature $T_{set_u}$.

Subsequently, it is determined whether a predetermined amount of time elapses after the cold/hot water outlet setting temperatures of the operating heat source machines are changed to the compensation temperature or whether the supply water temperature or the cold/hot water outlet temperatures of the operating heat source machines are in an allowable range set to be close to the compensation temperature $T_{set_u}$ (step SA12). When the cold/hot water outlet setting temperature of the heat source machine to be subtracted is not changed to $T_{set_u}$ in step SA10, it is determined in step SA12 whether a predetermined amount of time elapses after the cold/hot water outlet setting temperatures of the operating heat source machines are changed to the compensation temperature or whether the cold/hot water outlet temperature of the operating heat source machines except the heat source machine to be subtracted are in the allowable range set to be close to $T_{set_u}$.

When it is determined that the predetermined amount of time elapses or that the supply water temperature and the like are in the allowable range, an operation stop instruction is output to the heat source machine to be subtracted and the cold/hot water pump corresponding to the heat source machine (step SA13).

Then, it is determined whether a predetermined amount of time elapses after the heat source machine subtracting instruction is given or whether the cold/hot water pump corresponding to the heat source machine to be subtracted is stopped (step SA14). When it is determined that the predetermined amount of time elapses or that the cold/hot water pump is stopped ("YES" in step SA14), the cold/hot water outlet setting temperatures of the heat source machines in operation are changed from the compensation temperature $T_{set_u}$ to the target supply water temperature $T_{set}$ (step SA15) and then the supply water temperature compensating process ends.

As described above, in the heat source system 1 according to this embodiment and the control method thereof, when changing the number of heat source machines operating, the change in the supply water temperature when a heat source machine is added or subtracted is anticipated, the cold/hot water outlet temperature is calculated as the compensation temperature $T_{set_u}$ u such that the supply water temperature is equal to the target supply water temperature $T_{set}$, and the compensation temperature $T_{set_u}$ is set as the cold/hot water outlet setting temperatures of the operating heat source machines.

Accordingly, for example, when a heat source machine is added, it is possible to supplement the capability shortfall with the operating heat source machines in the period until the capability is exercised after the heat source machine to be additionally started is started. When a heat source machine is subtracted, it is possible to supplement the shortfall with the operating heat source machines in a state in which the heat source machine to be stopped does not exercise its capability.

As a result, it is possible to prevent the supply water temperature from being separated from the target supply water temperature when a heat source machine is actually added or subtracted and it is thus possible to supply cold/hot water with a stabilized temperature to the external load even when changing the number of heat source machines operating.

In this embodiment, the compensation temperature $T_{set_u}$ may be set for a heat source machine to be added or subtracted in addition to the heat source machines which continuously operate.

Second Embodiment

A heat source system according to a second embodiment of the present invention and a control method thereof will be described below with reference to the accompanying drawings.

In the heat source system according to the first embodiment and the control method thereof, the separation of the supply water temperature from the target supply water temperature is avoided by supplementing the capability shortfall of the heat source machine to be added or subtracted with the operating heat source machines. However, for example, there is a possibility that the compensation temperature $T_{set_u}$ departs from the operable range of the operating heat sources and causes a trip or the like.

Therefore, in order to avoid this problem, for example, an allowable range of the cold/hot water outlet setting temperature based on the capability of a heat source machine is set in advance and the compensation temperature is made not to depart from the allowable range.

Specifically, when a heat medium is cooled, it is determined whether the compensation temperature calculated in step SA2 in FIG. 2 is lower than the lower limit of the cold/hot water outlet setting temperature registered in advance. When the compensation temperature is lower than the lower limit, the lower limit of the cold/hot water outlet setting temperature is set as the compensation temperature.

Similarly, when a heat medium is heated, it is determined whether the compensation temperature calculated in step SA2 in FIG. 2 is higher than the upper limit of the cold/hot water outlet setting temperature registered in advance. When the compensation temperature is higher than the upper limit, the upper limit of the cold/hot water outlet setting temperature is set as the compensation temperature.

Accordingly, it is possible to avoid separation of the supply water temperature from the target supply water temperature and to prevent trips of the operating heat source machines.

Third Embodiment

A heat source system according to a third embodiment of the present invention and a control method thereof will be described below with reference to the accompanying drawings.

In the heat source system according to the second embodiment and the control method thereof, when the compensation temperature is lower than the lower limit of the cold/hot water outlet setting temperature or is higher than the upper limit thereof, the lower limit or the upper limit is set as the compensation temperature.

However, in this treatment, it is difficult to effectively suppress an increase or a decrease in the supply water temperature. Accordingly, in this embodiment, in order to cause the operating heat source machines to further exercise their capability, the flow rate of the operating heat source machines is increased. Specifically, the setting flow rate of the operating heat source machines is changed to the maximum flow rate $f_{n_max}$.

In the heat source system according to this embodiment and the control method thereof, the elements common to the first embodiment will not be repeatedly described and only differences therefrom will be described.

Figure 5:
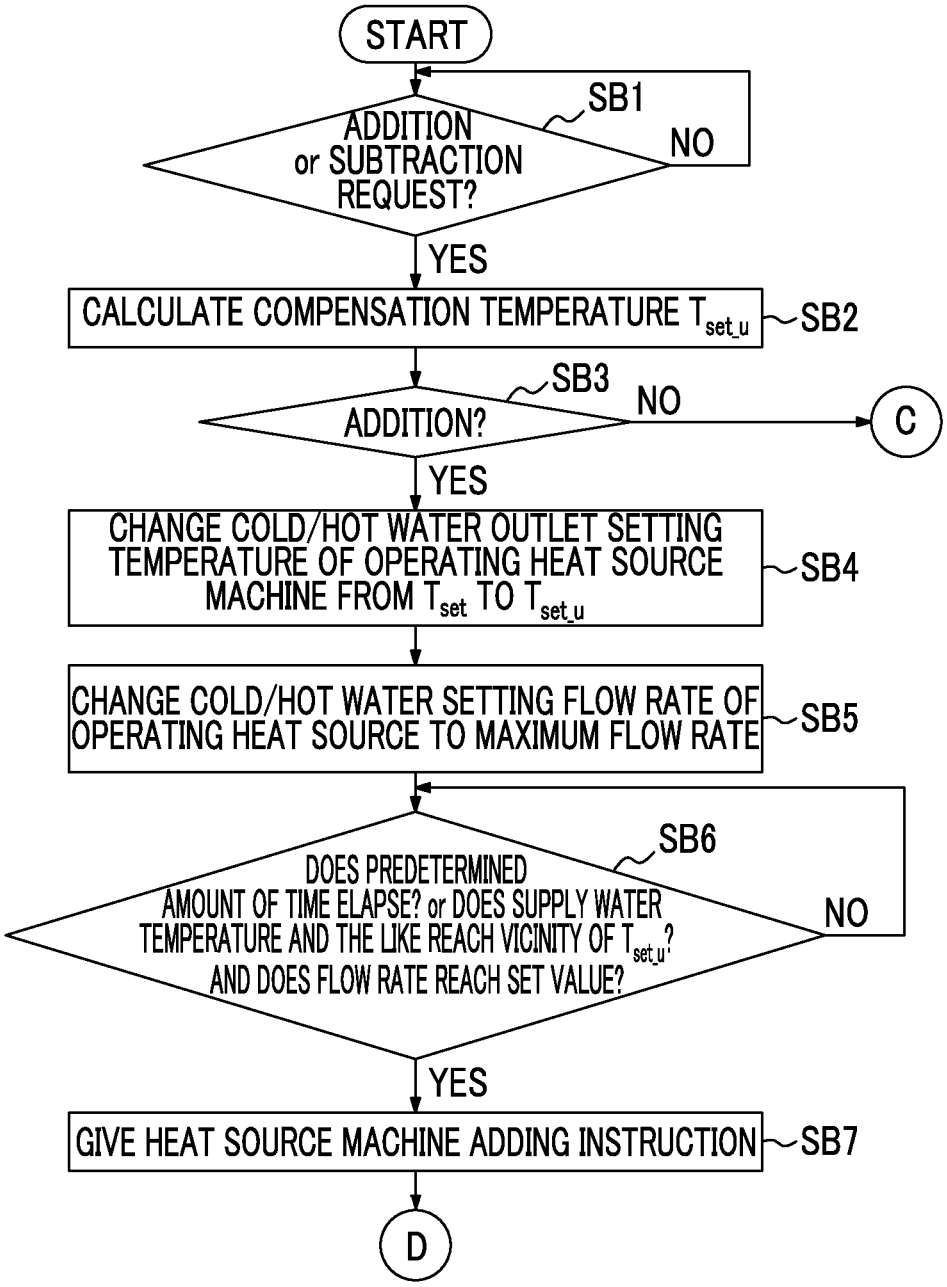
FIG. 5 is a flowchart illustrating a supply water temperature compensating process according to a third embodiment of the present invention.
Figure 6:
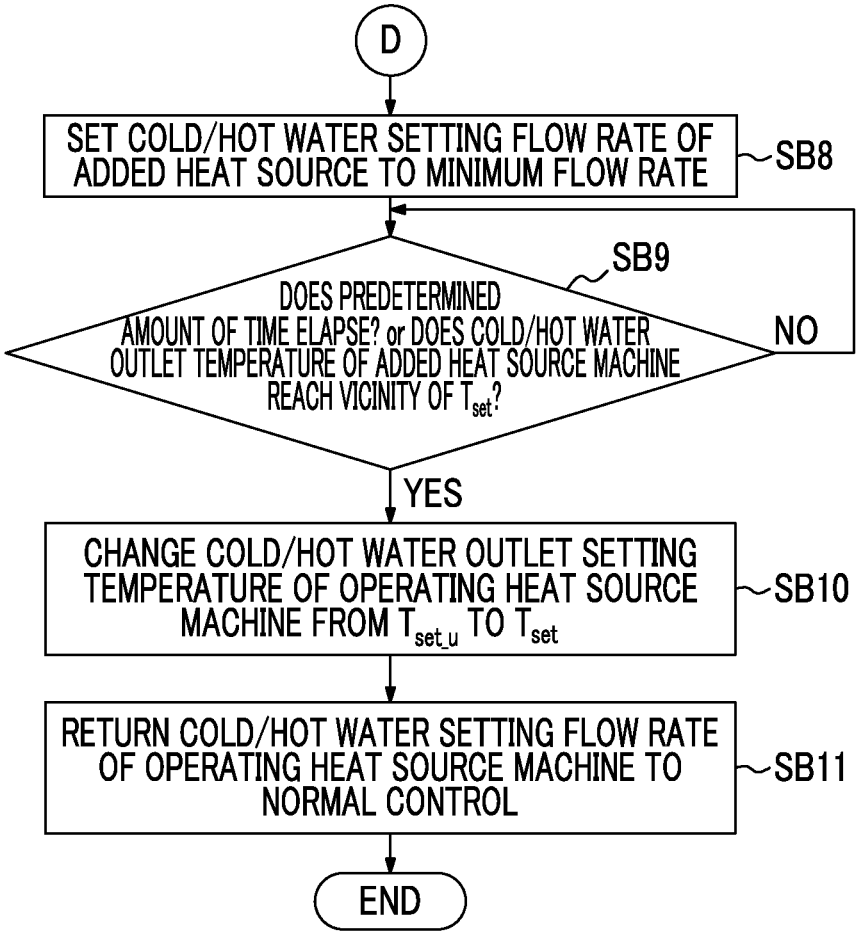
FIG. 6 is a flowchart illustrating the supply water temperature compensating process according to the third embodiment of the present invention.
Figure 7:
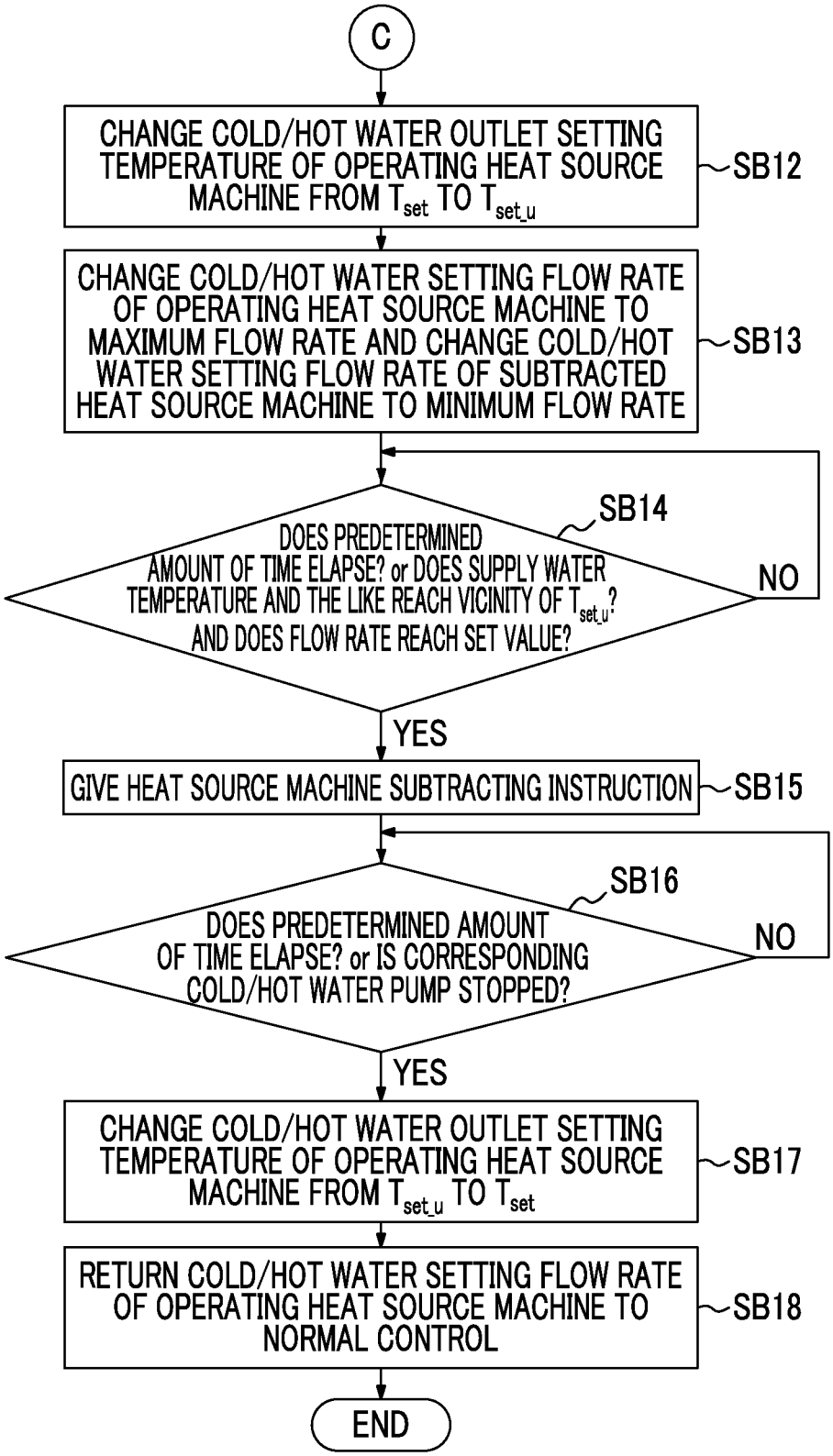
FIG. 7 is a flowchart illustrating the supply water temperature compensating process according to the third embodiment of the present invention.

FIGS. 5 to 7 are flowcharts illustrating a supply water temperature compensating process according to this embodiment.

First, when an addition or subtraction request is input ("YES" in step SB1 in FIG. 5), the compensation temperature is calculated (step SB2). In this embodiment, since the setting flow rates of the operating heat source machines are changed to the maximum flow rate, the calculation of the compensation temperature is performed on the basis thereof. Specifically, the compensation temperature $T_{set_u}$ is calculated using Expression (3).

$$T_{set_u} = \frac{T_{set}\left(\sum_{i=1}^{n-1} f_i + f_{n_min}\right) - f_{n_min} \times t_{ave_r}}{\sum_{i=1}^{n-1} f_{i_max}} \quad (3)$$

Then, it is determined whether a heat source machine is added (step SB3). When it is determined that a heat source machine is added ("YES" in step SB3), the cold/hot water outlet setting temperatures of the operating heat source machines are changed from the target supply water temperature $T_{set}$ to the compensation temperature $T_{set_u}$ and the cold/hot water setting flow rates thereof are changed to the maximum flow rate (steps SB4 and SB5).

Subsequently, it is determined in step SB6 whether a predetermined amount of time elapses after the cold/hot water outlet setting temperatures of the heat source machines are changed to the compensation temperature or whether the supply water temperature or the cold/hot water outlet temperatures of the operating heat source machines are in an allowable range set to be close to the compensation temperature $T_{set_u}$ and whether the flow rate reaches the maximum flow rate. When it is determined that the predetermined amount of time elapses or that the supply water temperature or the cold/hot water outlet temperatures of the operating heat source machines are in the allowable range and that the flow rate reaches the maximum flow rate ("YES" in step SB6), a start instruction is output to the heat source machine to be added and the flow rate of cold/hot water flowing into the heat source machine is set to the minimum flow rate (step SB7 and step SB8 in FIG. 6).

When the predetermined amount of time elapses from the heat source machine is started or when the cold/hot water outlet temperature of the started heat source machine is in the allowable range set to be close to the target supply water temperature $T_{set}$ ("YES" in step SB9), the cold/hot water outlet setting temperatures of the operating heat source machines are changed from the compensation temperature $T_{set_u}$ to the target supply water temperature $T_{set}$ (step SB10), the cold/hot water flow rates of the operating heat source machines are then returned to the normal control (step SB11), and then the supply water temperature compensating process ends.

On the other hand, when a heat source machine is added and the cold/hot water outlet setting temperatures of the operating heat source machines are changed from the target supply water temperature $T_{set}$ to the compensation temperature $T_{set_u}$ (step SB12 in FIG. 7), the cold/hot water setting flow rates of the heat source machines continuously operating are changed to the maximum flow rate and the cold/hot water setting flow rate of the heat source machine to be subtracted is changed to the minimum flow rate (steps SB13). Subsequently, it is determined whether a predetermined amount of time elapses after the cold/hot water outlet setting temperatures of the heat source machines are changed to the compensation temperature or whether the supply water temperature or the cold/hot water outlet temperatures of the operating heat source machines are in an allowable range set to be close to the compensation temperature $T_{set_u}$ and whether the flow rates of the heat source machines reach the setting flow rates (step SB14).

In this case, similarly to the first embodiment, in step SB12, the cold/hot water outlet setting temperatures of the operating heat source machines except the heat source machine to be subtracted may be changed. In this case, in step SB14, it is determined whether a predetermined amount of time elapses after the cold/hot water outlet setting temperatures of the heat source machines are changed to the compensation temperature or whether the cold/hot water outlet temperatures of the operating heat source machines except the heat source machine to be subtracted become close to the compensation temperature $T_{set_u}$.

When it is determined that the predetermined amount of time elapses or that the supply water temperature and the like are in the allowable range and that the flow rates reach the setting flow rates ("YES" in step SB14), an operation stop instruction is output to the heat source machine to be subtracted and the cold/hot water pump corresponding to the heat source machine (step SB15).

When it is determined that the predetermined amount of time elapses after the heat source machine subtracting instruction is given or that the pump corresponding to the heat source machine to be subtracted is stopped ("YES" in step SB16), the cold/hot water outlet setting temperatures of the operating heat source machines in operation are changed from the compensation temperature $T_{set_u}$ to the target supply water temperature $T_{set}$ (step SB17), the cold/hot water flow rates of the operating heat source machines are returned to the normal control (step SB18), and then the supply water temperature compensating process ends.

As described above, in the heat source system according to this embodiment and the control method thereof, it is possible to broaden the control width of the supply water temperature by additionally performing the flow rate control in addition to the temperature control, and it is possible to cause the operating heat source machines to further exercise their capability. Accordingly, it is possible to supplement the capability shortfall when the heat source machine to be added or subtracted is additionally started or stopped with the operating heat source machines as much as possible and it is possible to further suppress the variation in the supply water temperature when changing the number of heat source machines operating.

The aforementioned flow rate control according to the third embodiment may be performed, for example, only when the compensation temperature $T_{set_u}$ calculated in step SA2 in FIG. 2 departs from an upper-lower range of the cold/hot water outlet setting temperature which is set in advance. That is, in this case, it is determined whether the compensation temperature departs from the upper-lower range of the cold/hot water outlet setting temperature set in advance, and the compensation temperature is recalculated using Expression (3) when it is determined that the compensation temperature departs from the range. The recalculated compensation temperature is set as the cold/hot water outlet setting temperatures of the operating heat source machines, the setting flow rates of the heat source machines are set to the maximum flow rate, and the setting flow rate of the heat source machine to be added or subtracted is set to the minimum flow rate.

By employing this configuration, the flow rates can be adjusted only in a situation which cannot be coped with by only changing the temperature, and it is thus possible to skip unnecessary flow rate adjustment.

Fourth Embodiment

A heat source system according to a fourth embodiment of the present invention and a control method thereof will be described below with reference to the accompanying drawings.

In the heat source systems according to the first to third embodiments and the control methods thereof, the variation in the supply water temperature at the time of changing the number of heat source machines operating is suppressed by supplementing the capability shortfall at the time of starting or stopping the heat source machine to be added or subtracted by increasing the outputs of the operating heat source machines.

However, for example, at the time of adding a heat source machine, the capability of the operating heat source machines may reach the upper limit. In this case, the exercitation of capability of the operating heat source machines cannot be expected.

Accordingly, in the heat source system according to this embodiment and the control method thereof, when the capability of the operating heat source machines reaches the upper limit at the time of adding a heat source machine, the subsequent determination process is skipped and the heat source machine to be added is rapidly started.

Figure 8:
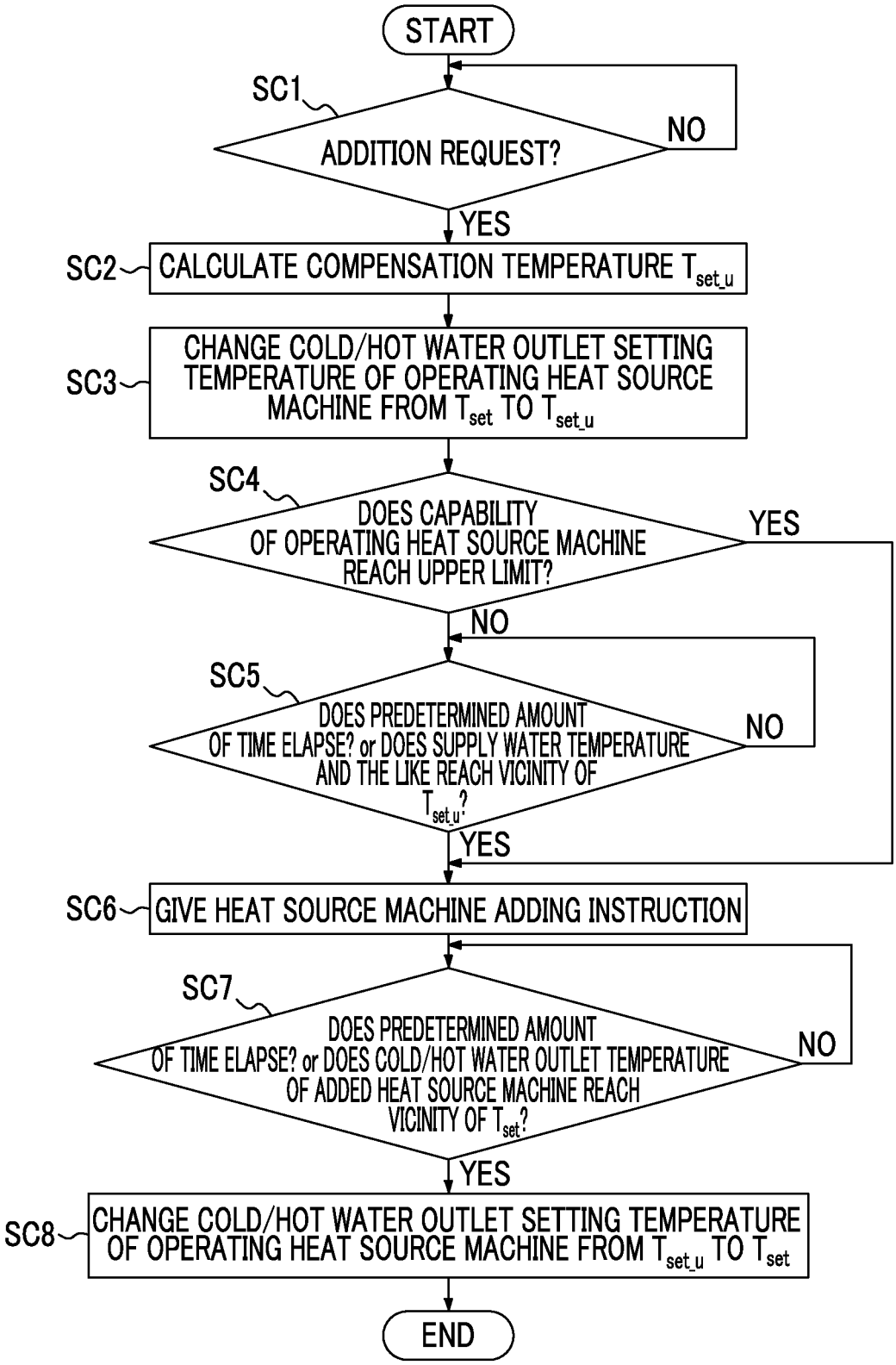
FIG. 8 is a flowchart illustrating an example of a supply water temperature compensating process according to a fourth embodiment of the present invention.

An example of a supply water temperature compensating process according to this embodiment will be described below with reference to FIG. 8.

First, when an addition request is input (step SC1), the compensation temperature $T_{set_u}$ is calculated (step SC2) and the cold/hot water outlet setting temperatures are changed from the target supply water temperature $T_{set}$ to the compensation temperature $T_{set_u}$ (step SC3), Subsequently, it is determined whether the capability of the operating heat source machines reaches the upper limit (step SC4). Here, whether the capability of the operating heat source machines reaches the upper limit can be determined, for example, depending on whether the current of a compressor motor reaches a predetermined upper limit, whether a heat source machine load factor reaches a predetermined upper limit, whether a heat source machine vane opening reaches an upper limit, and the like. Some of these determinations may be combined.

When it is determined that some operating heat source machines reach the upper limit ("YES" in step SC4), the process of determining whether a predetermined amount of time elapses in step SC5 or the like is skipped and the heat source machine to be added is immediately started (step SC6). In step SC4, it may be determined whether plural operating heat source machines (which include all the operating heat source machines) instead of some operating heat source machines reach the upper limit, and the process of determining whether a predetermined amount of time elapses or the like may be skipped and the heat source machine to be added may be immediately started when the determination result is "YES".

When it is determined that the predetermined amount of time elapses from the starting of the heat source machine or that the cold/hot water outlet temperature of the started heat source machine is in the allowable range set to be close to the target supply water temperature $T_{set}$ ("YES" in step SC7), the cold/hot water outlet setting temperatures of the operating heat source machines are changed from the compensation temperature $T_{set_u}$ to the target supply water temperature $T_{set}$ (step SC8) and then the supply water temperature compensating process ends.

In the heat source system according to this embodiment and the control method thereof, when the capability of the operating heat source machines reaches the upper limit, it is possible to rapidly start the heat source machine to be added without performing subsequent unnecessary determination processes.

This embodiment can be applied by combination with the aforementioned embodiments as well as the first embodiment.

Fifth Embodiment

A heat source system according to a fifth embodiment of the present invention and a control method thereof will be described below with reference to the accompanying drawings.

In the heat source systems according to the first to third embodiments and the control methods thereof, the measured value $t_{ave_r}$ of the return water temperature of cold/hot water is used as the cold/hot water outlet setting temperature of the heat source machine to be added or subtracted at the time of calculating the compensation temperature. This is because since the capability of the heat source machine is not exercised just after the addition or subtraction and thus the cold/hot water of the return water temperature flowing from the return header 4 is considered to be output from the heat source machine to be added or subtracted.

However, the measured value of the return water temperature used in the first embodiment is a measured value of the return water temperature before the heat source machine to be added or subtracted is started or stopped and is different from the return water temperature after the heat source machine is actually started or stopped.

For example, when the supply water temperature is changed by changing the number of heat source machines operating, the return water temperature is also changed accordingly. By this chain reaction, there is a possibility that the supply water temperature and the return water temperature slowly rise or fall and may diverge from the original value.

Therefore, in this embodiment, a theoretical value of the return water temperature is calculated, the theoretical value is considered as the cold/hot water outlet setting temperature of the heat source machine to be added or subtracted, and the compensation temperature is calculated.

For example, in the schematic configuration of the heat source system illustrated in FIG. 4, when a request load is Q and the theoretical value of the return water temperature is $T_{r_idl}$, a relationship of Expression (4) is established between the heat quantity of the cold/hot water supplied from the supply header 5 to the load side and the heat quantity of the cold/hot water flowing from the return header 4.

$$Fg \times \Delta t = \left(\sum_{i=1}^{n-1} f_i + f_{n_min}\right) \times (T_{r_idl} - T_{set}) \times c = Q \tag{4}$$

In Expression (4), Fg represents the flow rate of cold/hot water supplied to the load side, Δt represents the temperature difference between the supply water temperature and the return water temperature, $f_i$ represents the flow rate of an operating heat source machine, $f_{i_min}$ represents the flow rate of the heat source machine to be added or subtracted and is set to the minimum flow rate. $T_{set}$ represents the supply water temperature and c represents the specific heat.

The theoretical value of the return water temperature is given by Expression (5) based on Expression (4).

$$T_{r_idl} = \frac{Q/c + T_{set}\left(\sum_{i=1}^{n-1} f_i + f_{n_min}\right)}{\left(\sum_{i=1}^{n-1} f_i + f_{n_min}\right)} \quad (5)$$

In Expression (2), the compensation temperature $T_{set_u}$ a is calculated using $T_{r_idl}$ instead of $t_{ave_r}$.

In this way, by using the theoretical value of the return water temperature as the cold/hot water outlet temperature of the heat source machine to be added or subtracted to calculate the compensation temperature, it is possible to make the cold/hot water outlet temperature of the heat source machine close to the actual temperature. Accordingly, it is possible to improve the calculation accuracy of the compensation temperature and to make the supply water temperature closer to the target supply water temperature at the time of changing the number of heat source machines operating.

In this embodiment, the cold/hot water outlet temperature of the heat source machine to be added or subtracted may be calculated using both the theoretical value $T_{r_idl}$ of the return water temperature and the measured value $t_{ave_r}$ of the return water temperature. In this case, the compensation temperature is given by Expression (6).

In Expression (6), the cold/hot water outlet temperature of a heat source machine is obtained by adding values which are obtained by proportionally dividing the theoretical value $T_{r_idl}$ of the return water temperature and the measured value $t_{ave_r}$ of the return water temperature. Specifically, a value obtained by adding a value obtained by multiplying the theoretical value $T_{r_idl}$ of the return water temperature by coefficient $\alpha$ ($0 \le \alpha \le 1$) and a value obtained by multiplying the measured value $t_{ave_r}$ of the return water temperature by coefficient $(1-\alpha)$ is used as the cold/hot water outlet temperature of the heat source machine to be added or subtracted. In Expression (6), the value of a can be arbitrarily set.

$$T_{set_u} = \frac{T_{set}\left(\sum_{i=1}^{n-1} f_i + f_{n_min}\right) - f_{n_min} \times ((1-\alpha)t_{ave_r} + \alpha \times T_{r_idl})}{\sum_{i=1}^{n-1} f_i} \quad (6)$$

Sixth Embodiment

A heat source system according to a sixth embodiment of the present invention and a control method thereof will be described below with reference to the accompanying drawings.

In the heat source system according to the fifth embodiment and the control method thereof, the compensation temperature is calculated in consideration of the variation of the cold/hot water outlet temperature of the heat source machine to be added or subtracted, but the variations in the cold/hot water outlet temperatures of the operating heat source machines are not reflected in the calculation of the compensation temperature.

That is, when the return water temperature is changed, the cold/hot water outlet temperatures of the operating heat source machines may be affected and the cold/hot water outlet temperatures set to the compensation temperature may not be tracked depending on the operation states of the operating heat source machines. For example, when the cold/hot water outlet setting temperatures of the operating heat source machines are set to a constant temperature and the cold/hot water inlet temperatures of the operating heat source machines are changed with the change of the return water temperature, the operating heat source machines are requested to change their capability. In this case, when the responses of the operating heat source machines to the changes in the cold/hot water inlet temperatures are delayed, the cold/hot water outlet setting temperatures set to the compensation temperature cannot be tracked and the cold/hot water outlet temperatures of the operating heat source machines become different from the cold/hot water outlet setting temperatures. By anticipating this case, in this embodiment, the difference between the theoretical value of the return water temperature and the measured value of the return water temperature is included as a correction value in the expression for calculating the compensation temperature.

Expression (7) is an operational expression of the compensation temperature in this embodiment. In Expression (7), the correction value is expressed as a value obtained by multiplying the difference between the measured value of the return water temperature and the theoretical value of the return water temperature by a predetermined correction coefficient $\beta$ ($0 \le \beta \le 13$), $$T_{set_u} = \frac{T_{set}\left(\sum_{i=1}^{n-1} f_i + f_{n_min}\right) - f_{n_min} \times ((1-\alpha)t_{ave_r} + \alpha \times T_{r_idl})}{\sum_{i=1}^{n-1} f_i} + \beta \times (t_{ave_r} - T_{r_idl}) \quad (7)$$

In this way, by including the correction value corresponding to the difference between the theoretical value of the return water temperature and the measured value of the return water temperature in the operational expression of the compensation temperature, it is possible to set the compensation temperature in consideration of the change in the cold/hot water outlet temperature due to the cold/hot water inlet temperatures of the operating heat source machines. Accordingly, it is possible to make the supply water temperature close to the target supply water temperature even when the measured value of the return water temperature departs from the theoretical value of the return water temperature.

Seventh Embodiment

A heat source system according to a seventh embodiment of the present invention and a control method thereof will be described below with reference to the accompanying drawings.

In the heat source system according to the fifth or sixth embodiment and the control method thereof, the compensation temperature is calculated on the premise that the return water temperature is changed by changing the number of heat source machines operating.

However, for example, when the flow rate of the heat source machine to be added is raised at a predetermined change rate, the change in the supply water temperature due to the heat source machine to be added can be absorbed by the capability enhancement of the operating heat source machines. Accordingly, it is possible to allow the supply water temperature to track the target supply water temperature and thus to suppress the change in the return water temperature.

Figure 9:
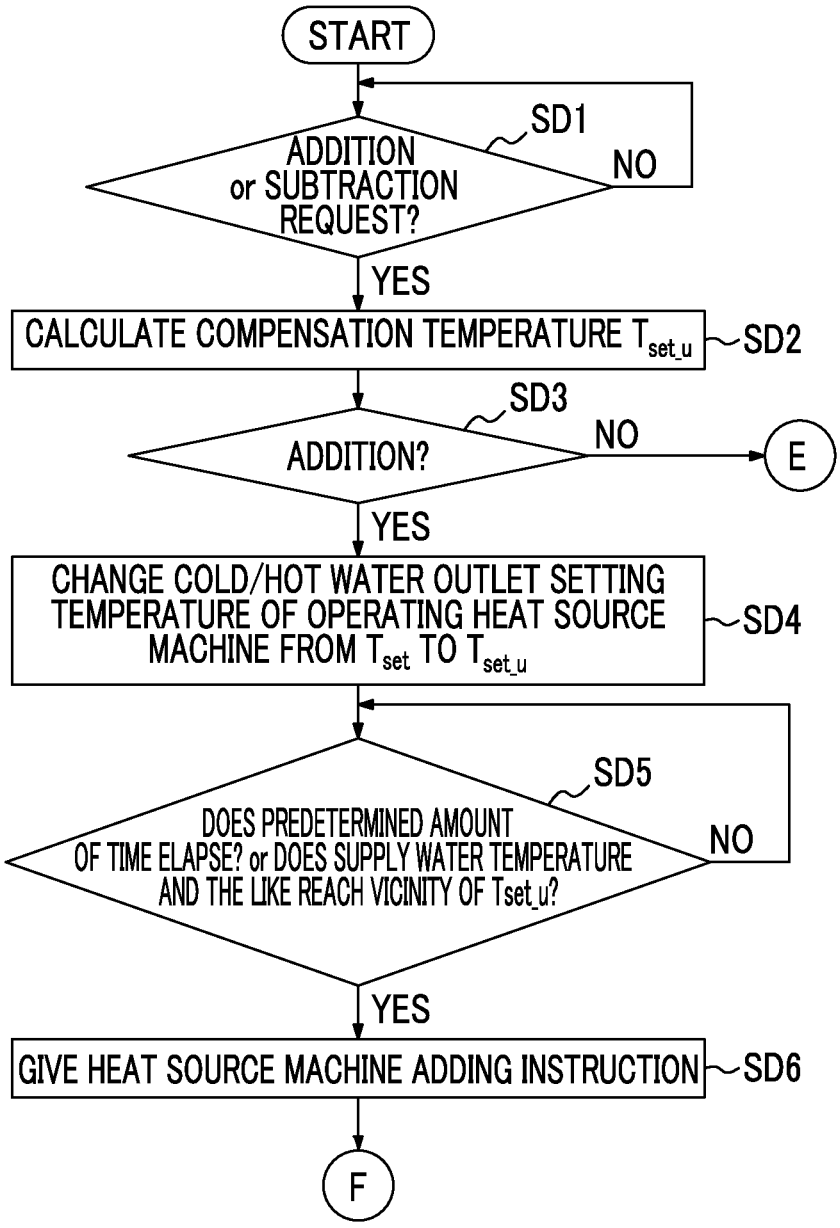
FIG. 9 is a flowchart illustrating an example of a supply water temperature compensating process according to a seventh embodiment of the present invention.

An example of a supply water temperature compensating process according to this embodiment will be described below with reference to FIGS. 9 to 11.

Figure 10:
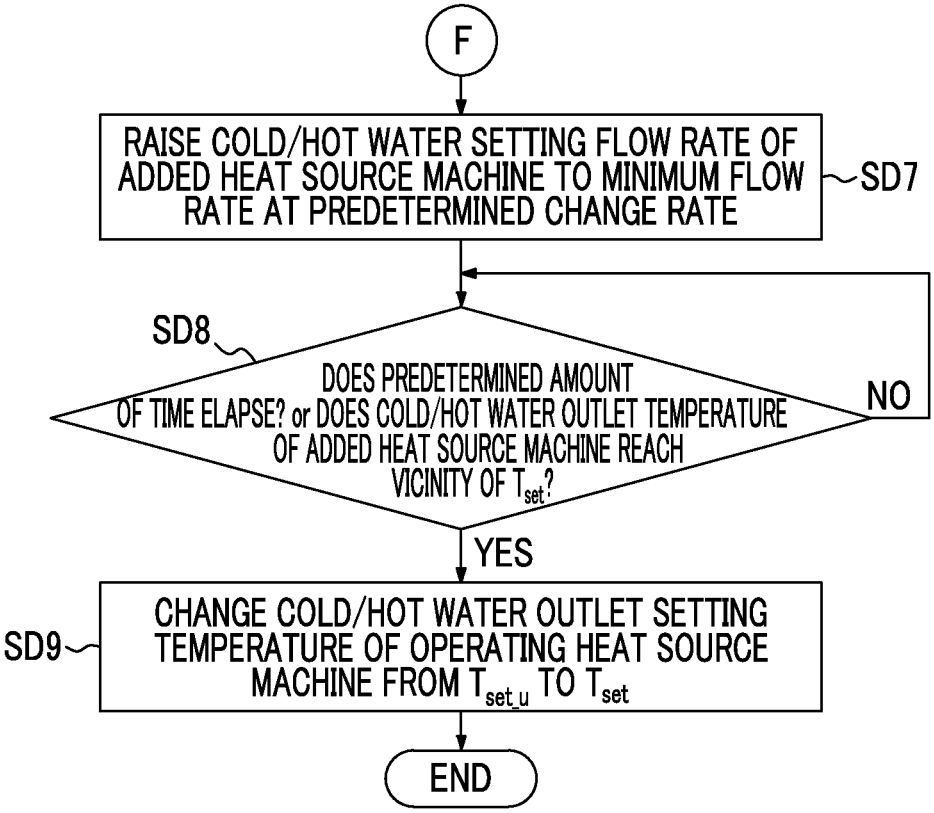
FIG. 10 is a flowchart illustrating an example of the supply water temperature compensating process according to the seventh embodiment of the present invention.

First, as illustrated in FIG. 10, in step SD7 of the supply water temperature compensating process according to this embodiment, the cold/hot water setting flow rate of the heat source machine to be added is raised to the minimum flow rate at a constant change rate. Here, the constant change rate is set to be equal to or less than a change range at which the supply water temperature can be kept at the target supply water temperature by exercitation of capability of the operating heat source machines even when the cold/hot water setting flow rate of the heat source machine to be added is changed at the rate.

Steps SD1 to SD6 and steps SD8 and SD9 correspond to steps SA1 to SA6 and steps SA8 and SA9 in FIG. 2 and thus description thereof will not be repeated.

Figure 11:
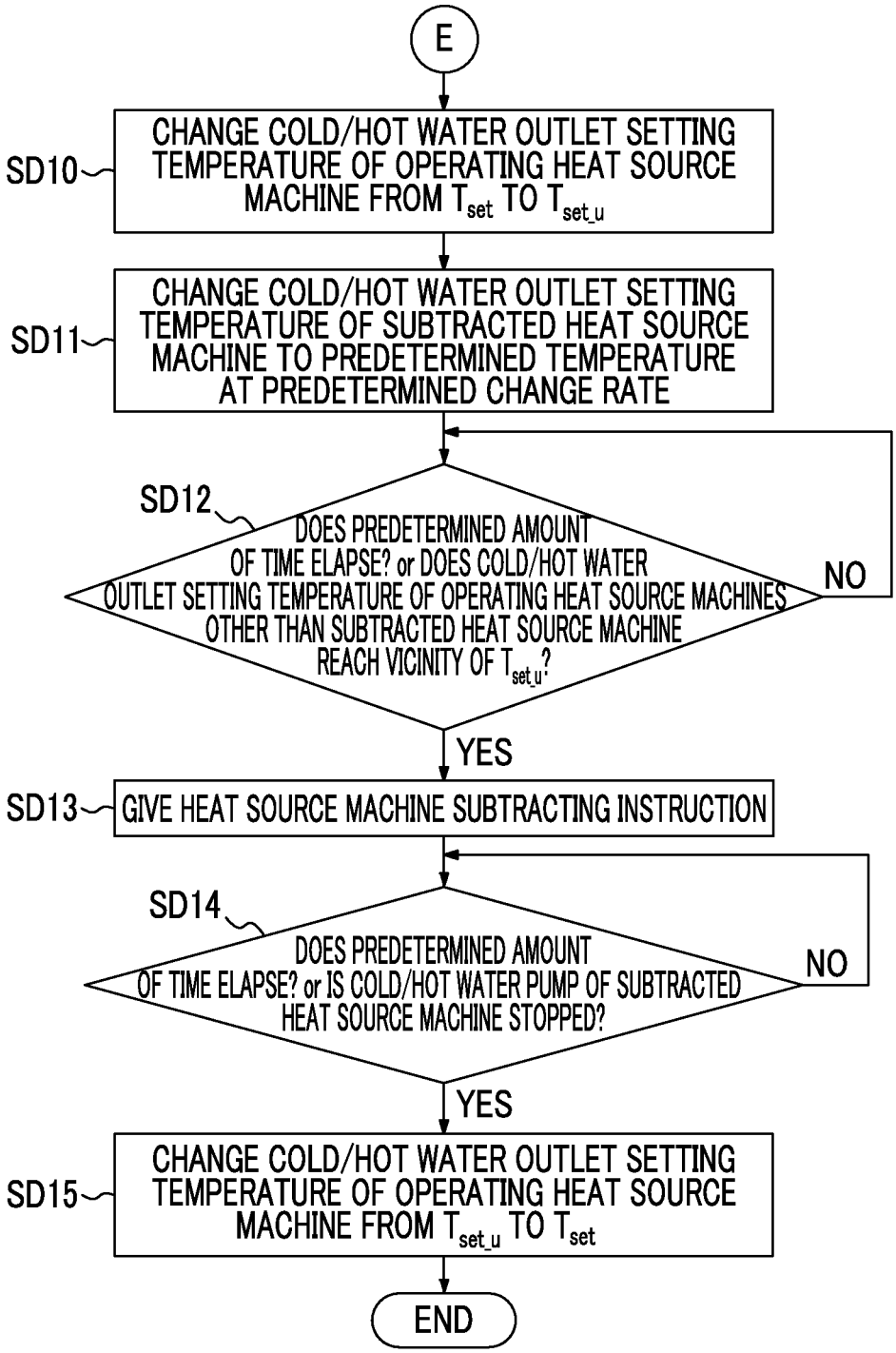
FIG. 11 is a flowchart illustrating an example of the supply water temperature compensating process according to the seventh embodiment of the present invention.

On the other hand, when it is determined in step SD3 (see FIG. 9) that a heat source machine is subtracted, the cold/hot water outlet setting temperatures of the operating heat source machines except the heat source machine to be subtracted is changed from the target supply water temperature $T_{set}$ to the compensation temperature $T_{set_u}$ and the cold/hot water outlet setting temperature of the heat source machine to be subtracted is changed to a predetermined temperature determined on the basis of the return water temperature at a constant change rate (steps SD10 and SD11 in FIG. 11). Here, the predetermined temperature is, for example, a temperature set in advance to be equal to or lower than the return water temperature when the heat source system performs cooling, and is a temperature set in advance to be equal to or higher than the return water temperature when the heat source system performs heating.

The constant change rate is set to be equal to or lower than a change rate at which the supply water temperature can track the target supply water temperature by capability enhancement of the operating heat source machines even when the cold/hot water outlet setting temperature of the heat source machine to be subtracted is changed at the rate.

Subsequently, it is determined whether a predetermined amount of time elapses after the cold/hot water outlet setting temperatures of the operating heat source machines except the heat source machine to be subtracted are changed to the compensation temperature or whether the cold/hot water outlet temperatures of the operating heat source machines except the heat source machine to be subtracted are in the allowable range set to be close to the compensation temperature $T_{set_u}$ (step SD12). When it is determined that the predetermined amount of time elapses or that the cold/hot water outlet temperatures of the operating heat source machines except the heat source machine to be subtracted are in the allowable range, an operation stop instruction is output to the heat source machine to be subtracted and the cold/hot water pump corresponding to the heat source machine (step SD13).

Subsequently, it is determined whether a predetermined amount of time elapses after the heat source machine operation stop instruction is output or whether the cold/hot water pump corresponding to the heat source machine to be subtracted is stopped (step SD14). When it is determined that the predetermined amount of time elapses or that the cold/hot water pump is stopped ("YES" in step SD14), the cold/hot water outlet setting temperatures of the operating heat source machines are changed from the compensation temperature $T_{set_u}$ to the target supply water temperature $T_{set}$ (step SD15) and then the supply water temperature compensating process ends.

As described above, in the heat source system according to this embodiment and the control method thereof, when a heat source machine is added, the change rate of the setting flow rate of the cold/hot water of the target heat source machine is set to the trackable range of the operating heat source machines, and it is thus possible to keep the supply water temperature close to the target supply water temperature by increasing the capability of the operating heat source machines.

When a heat source machine is subtracted, the change rate of the cold/hot water outlet setting flow rate of the target heat source machine is set to the trackable range of the operating heat source machines, and it is thus possible to keep the supply water temperature close to the target supply water temperature by increasing the capability of the operating heat source machines. Since the capability of the heat source machine to be subtracted is decreased by a predetermined amount before the subtraction, it is possible to suppress the influence of the subtraction on the system.

Eighth Embodiment

A heat source system according to an eighth embodiment of the present invention and a control method thereof will be described below with reference to the accompanying drawings.

Figure 12:
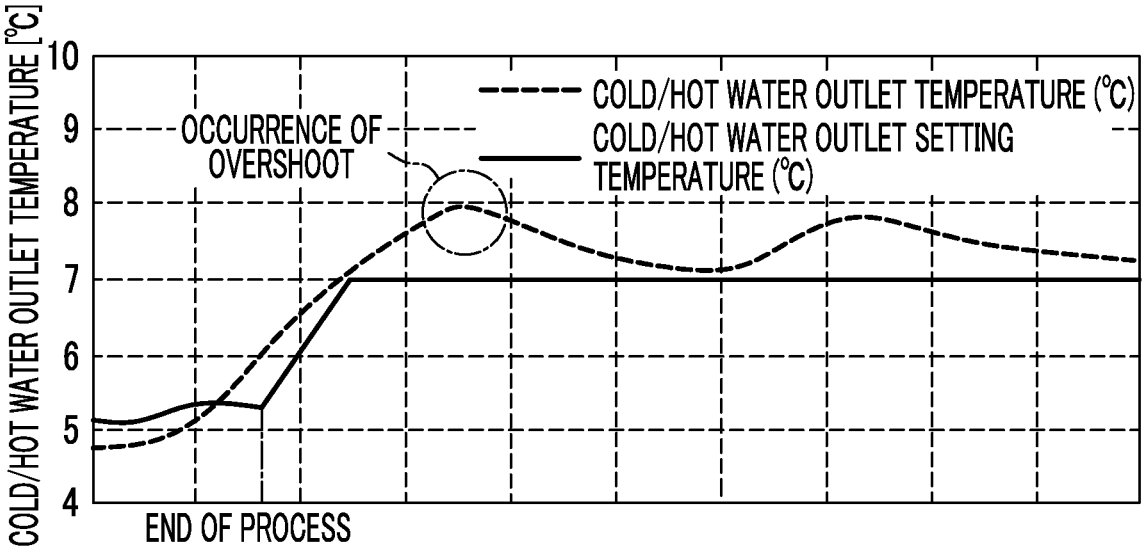
FIG. 12 is a diagram illustrating an example of an overshoot which occurs when a cold/hot water outlet setting temperature is step-like changed in a heat source system according to an eighth embodiment of the present invention.

In the first embodiment, after the heat source machine to be added or subtracted is started or stopped, the cold/hot water outlet setting temperatures of the operating heat source machines are changed from the compensation temperature to the target supply water temperature. At this time, when the temperature is gradually changed, the cold/hot water outlet temperatures of the operating heat source machines overshoot or undershoot the cold/hot water outlet setting temperatures as illustrated in FIG. 12 and thus there is a possibility that the supply water temperature is separated from the target supply water temperature after the supply water temperature compensating process ends.

Therefore, in this embodiment, an unnecessary overshoot or undershoot is prevented by setting the change rate of the cold/hot water outlet setting temperatures to be slower than normal after the supply water temperature compensating process ends. The change rate is empirically appropriately set to be equal to or less than a change rate at which an overshoot or undershoot does not occur and a specific example of the change rate is 0,005° C./sec.

Figure 13:
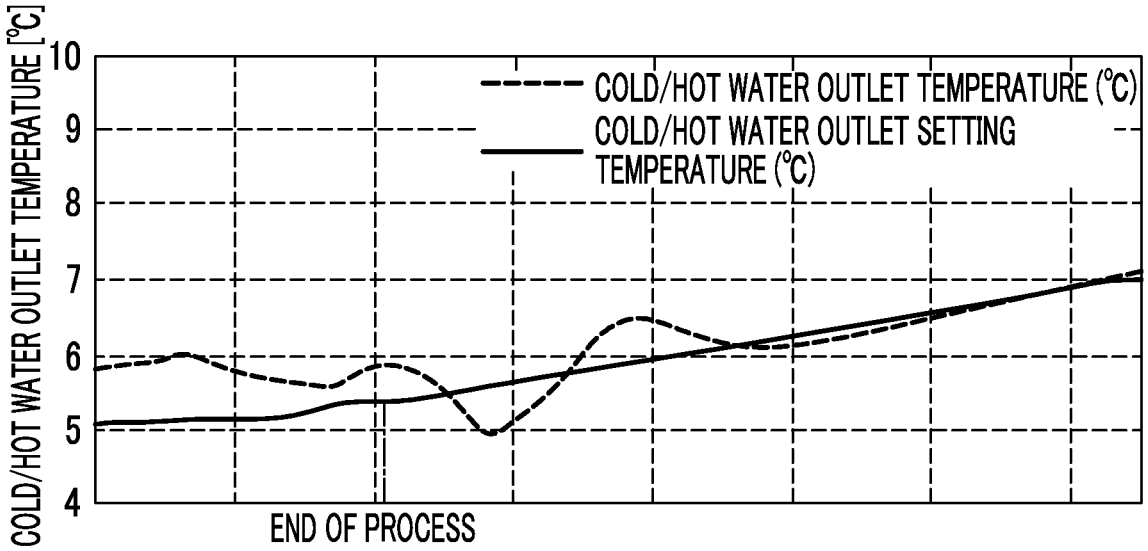
FIG. 13 is a diagram illustrating an effect in the heat source system according to the eighth embodiment of the present invention.

In this way, when the cold/hot water outlet setting temperatures are changed from the compensation temperature to the target supply water temperature, the change rate at that time is suppressed to be equal to or less than a change rate at which an overshoot or undershoot occurs and it is thus possible to avoid occurrence of an overshoot or undershoot, for example, as illustrated in FIG. 13. Accordingly, it is possible to keep the supply water temperature close to the target supply water temperature even just after the number of heat source machines operating is changed.

Ninth Embodiment

A heat source system according to a ninth embodiment of the present invention and a control method thereof will be described below with reference to the accompanying drawings.

In the fourth embodiment, the heat source machine to be added is rapidly started when the capability of the operating heat source machines reaches the upper limit. When plural operating heat source machines are present, the capability of some operating heat source machines may reach the upper limit but the capability of the other operating heat source machines may not reach the upper limit. One reason of this situation is that the maximum cold/hot water flow rates of the operating heat source machines are different from the rated cold/hot water flow rates. That is, when the maximum cold/hot water flow rates are equal to the rated cold/hot water flow rates and the cold/hot water outlet temperatures are equal to each other, all the heat source machines have the same load factor. However, when the maximum cold/hot water flow rates are not equal to the rated cold/hot water flow rates, the load factors of the heat source machines are different from one another even at the same cold/hot water outlet temperature and the heat source machines of which the capability reaches the upper limit and the heat source machines of which the capability does not reach the upper limit are present.

In this embodiment, when the operating heat source machines having reached the capability upper limit and the operating heat source machines not having reached the capability upper limit are mixed, the capability shortfalls of the operating heat source machines having reached the capability upper limit are supplemented with the other operating heat source machines not having reached the capability upper limit.

An example of a supply water temperature compensating process according to this embodiment will be described below with reference to FIGS. 14 to 17.

Figure 14:
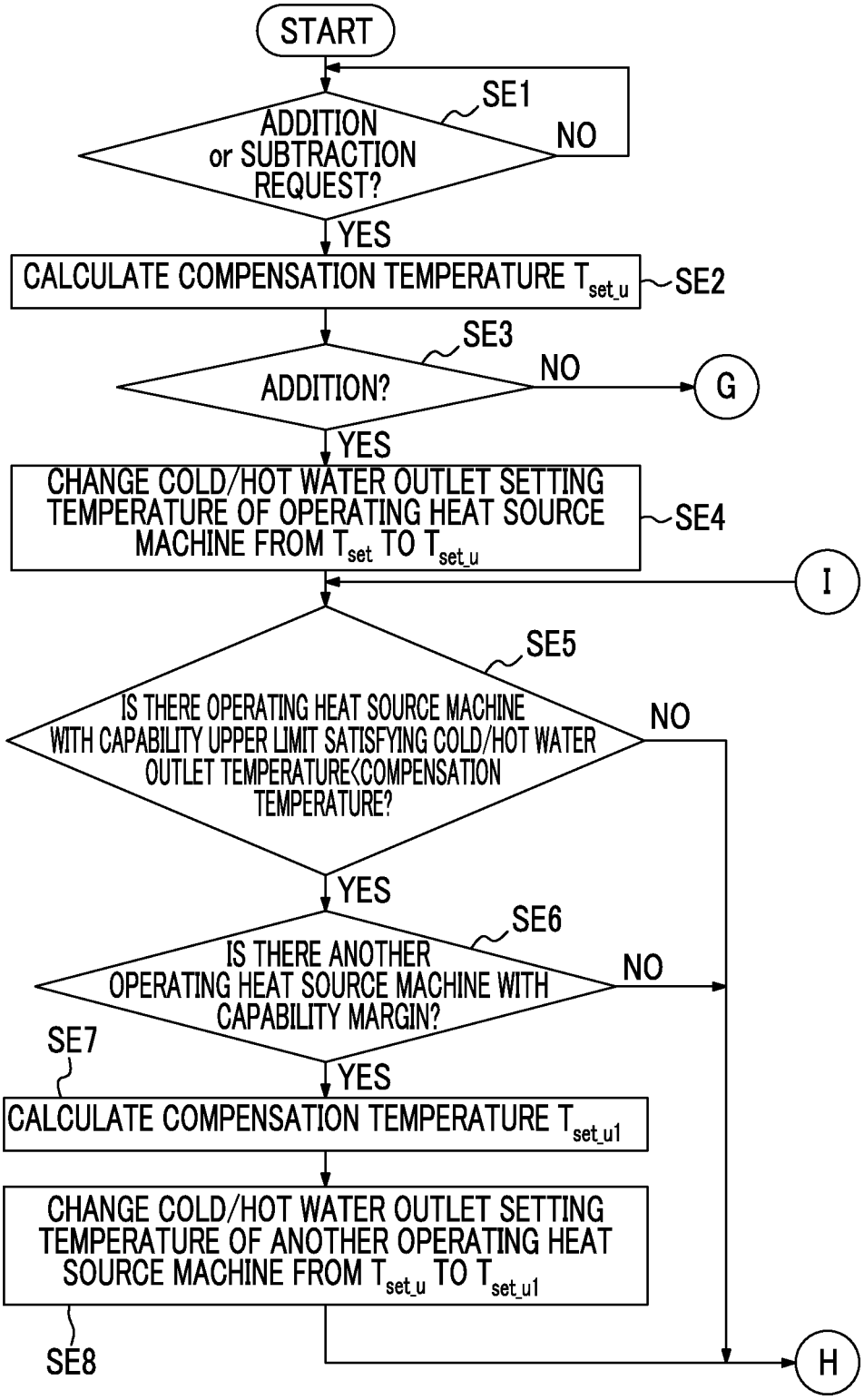
FIG. 14 is a flowchart illustrating an example of a supply water temperature compensating process according to a ninth embodiment of the present invention.

As illustrated in FIG. 14, in the supply water temperature compensating process according to this embodiment, when a heat source machine is added, it is determined in step SE5 whether an operating heat source machine of which the capability reaches the upper limit and of which the cold/hot water outlet temperature does not reach the compensation temperature is present. Steps SE1 to SE4 correspond to steps SA1 to SA4 in FIG. 2 and thus description thereof will not be repeated.

When it is determined that an operating heat source machine of which the capability reaches the upper limit and of which the cold/hot water outlet temperature does not reach the compensation temperature is present ("YES" in step SE5), it is determined whether another operating heat source machine of which the capability is less than the upper limit is present (step SE6). When it is determined that such an operating heat source machine is present ("YES" in step SE6), the compensation temperature $T_{set_ul}$ of the operating heat source machine is recalculated using Expressions (8) and (9) (step SE7).

Figure 15:
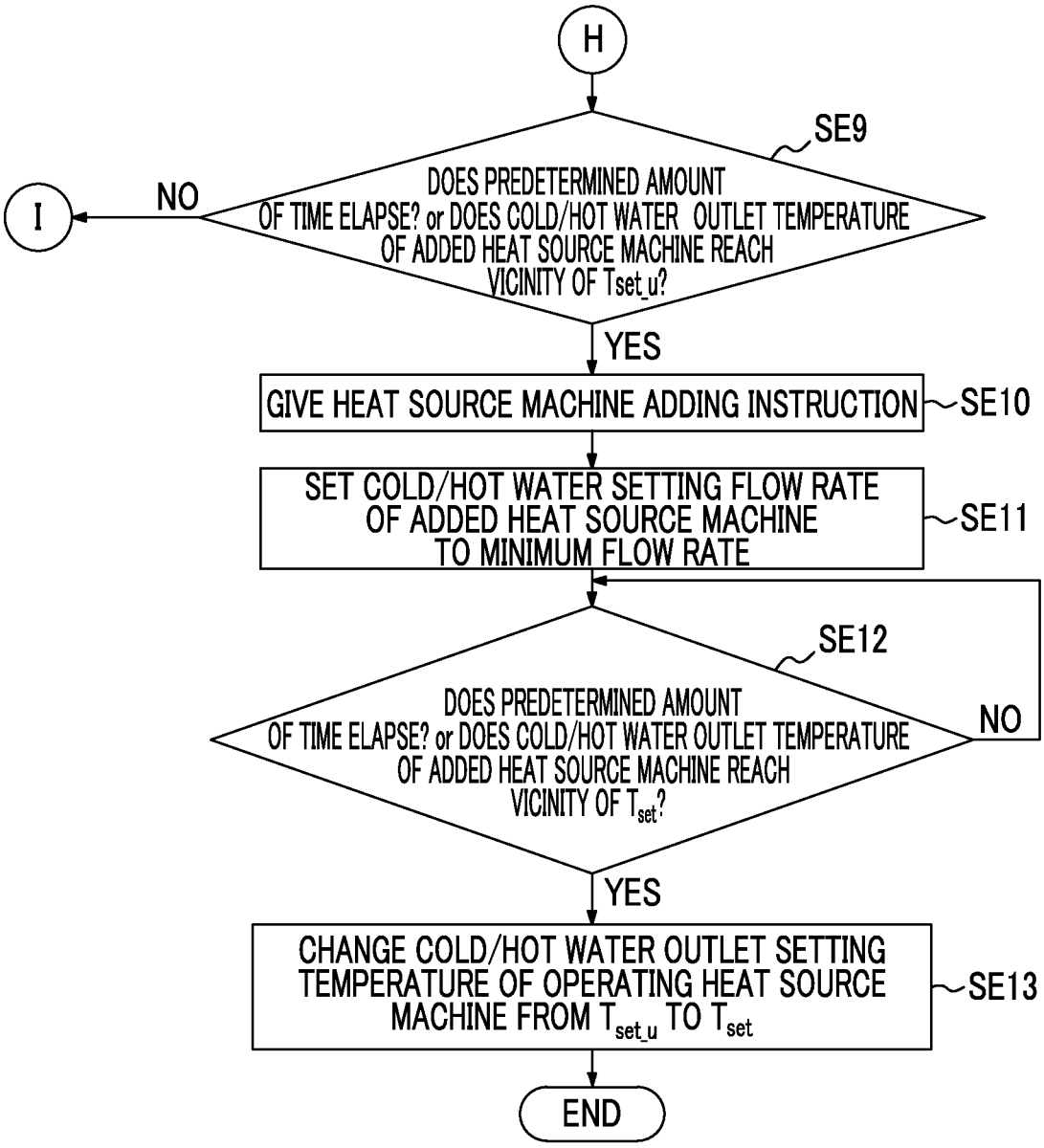
FIG. 15 is a flowchart illustrating an example of the supply water temperature compensating process according to the ninth embodiment of the present invention.

When the determination result of step SE5 or SE6 is "NO", the process flow goes to step SE9 in FIG. 15 to be described later.

$$Q_{lack} = \sum_{k} (t_{wout(k)} - T_{set_u}) \times f_k \tag{8}$$

$$T_{set_u1} = T_{set_u} - \frac{Q_{lack}}{\sum_{l} f_l} \tag{9}$$

The lack heat quantity $Q_{lack}$ of the operating heat source machine of which the capability has reached the upper limit is calculated using Expression (8). In Expression (8), k represents an operating heat source machine of which the capability has reached the upper limit and of which the cold/hot water outlet temperature has not reached to the setting temperature, $t_{wout}$ represents the cold/hot water outlet temperature of the operating heat source machine, and $f_k$ represents the flow rate of the heat source machine.

Subsequently, by applying the lack heat quantity $Q_{lack}$ calculated using Expression (8) to Expression (9), the compensation temperature of the operating heat source machine of which the capability is less than the upper limit is recalculated. Specifically, the compensation temperature is recalculated by dividing the lack heat quantity $Q_{lack}$ by the flow rate of the operating heat source machine of which the capability is less than the upper limit and subtracting the division result from the compensation temperature. In Expression (9), 1 represents the heat source machine of which the capability has not reached the upper limit and of which the cold/hot water outlet temperature has reached the compensation temperature $T_{set_u}$, and $T_{set_ul}$ represents the compensation temperature and is a compensation temperature for the operating heat source machine.

Subsequently, the compensation temperature $T_{set_ul}$ recalculated using Expression (9) is set as the cold/hot water outlet setting temperature of the operating heat source machine (step SE8). Then, it is determined whether a predetermined amount of time elapses after the compensation temperature $T_{set_ul}$ is set as the cold/hot water outlet setting temperature of the operating heat source machine or whether the supply water temperature reaches an allowable range set to be close to the compensation temperature $T_{set_u}$ (step SE9 in FIG. 15). When the compensation temperature $T_{set_ul}$ for the operating heat source machine is set, it may be determined whether the cold/hot water outlet temperature of the operating heat source machine reaches the allowable range set to be close to the compensation temperature $T_{set_ul}$. When the compensation temperature $T_{set_u}$ is set for all the operating heat source machines ("NO" in steps SE5 and SE6), it may be determined whether the cold/hot water outlet temperatures of the operating heat source machines reach the allowable range set to be close to the compensation temperature $T_{set_u}$.

When this condition is not satisfied ("NO" in step SE9), the process flow is returned to step SE5 and the subsequent processes thereof are repeatedly performed. Accordingly, in order to distribute the lack heat quantity to the heat source machines with a capability margin, the cold/hot water outlet setting temperature of the operating heat source machine not having reached the capability upper limit is updated every time.

When the condition of step SE9 is satisfied ("YES" in step SE9), an addition instruction is output to the heat source machine to be added (step SE10) and then the processes of steps SE11 to SE13 are performed. The processes of steps SE11 to SE13 correspond to steps SA7 to SA9 in FIG. 2 and thus description thereof will not be repeated.

Figure 16:
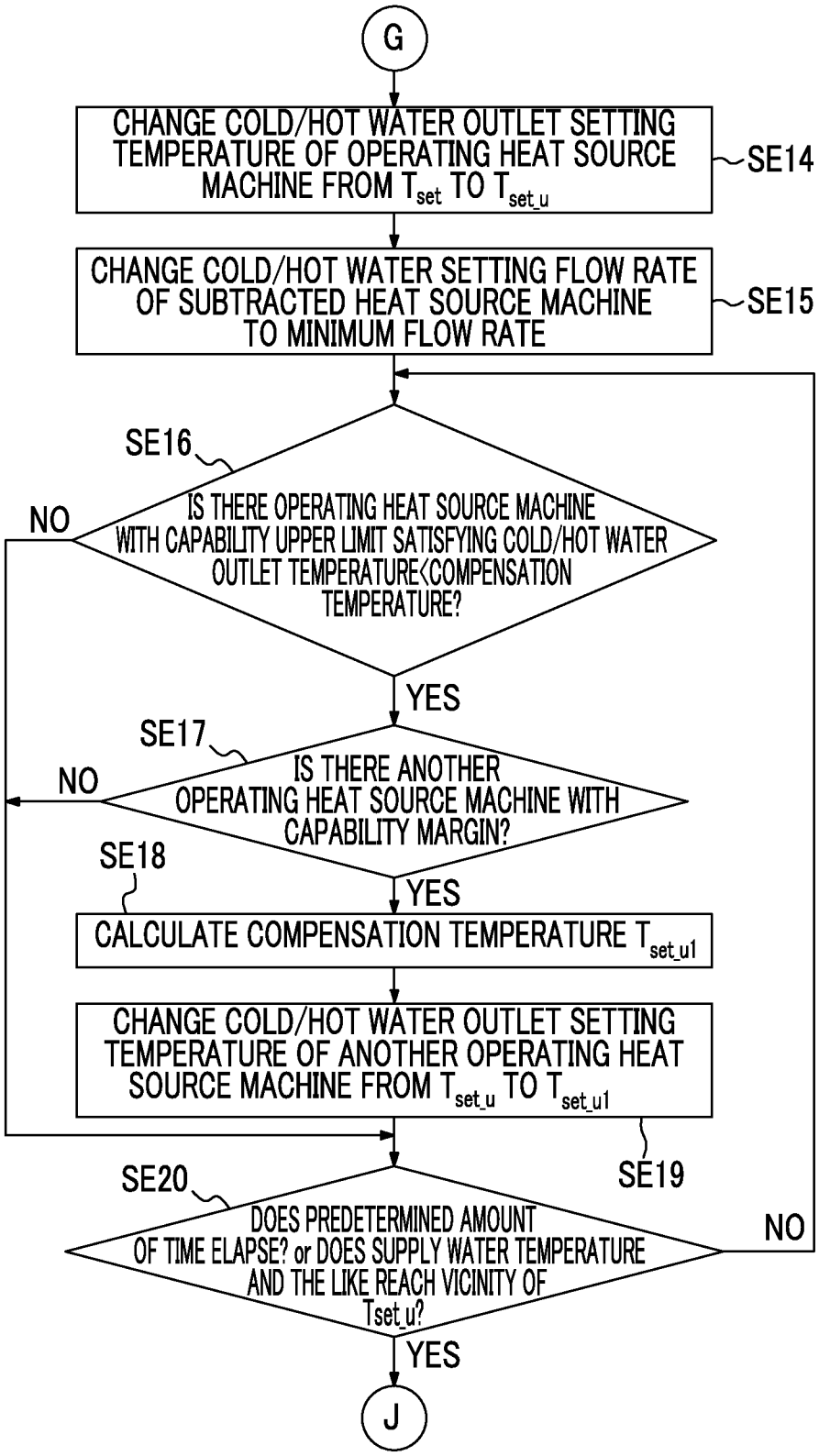
FIG. 16 is a flowchart illustrating an example of the supply water temperature compensating process according to the ninth embodiment of the present invention.
Figure 17:
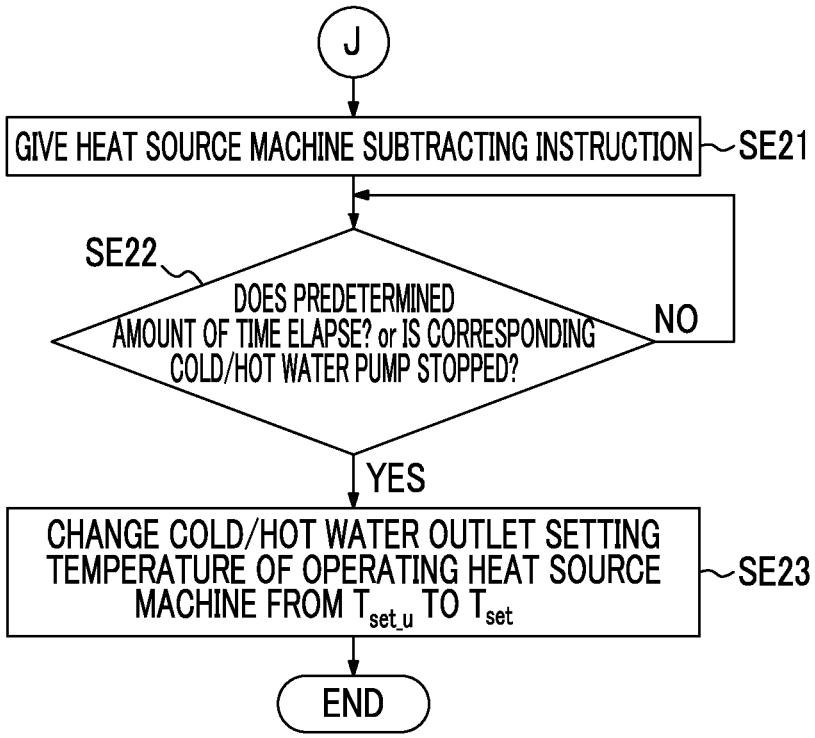
FIG. 17 is a flowchart illustrating an example of the supply water temperature compensating process according to the ninth embodiment of the present invention.

Similarly, when it is determined in step SE3 that a heat source machine is subtracted, the processes of steps SE14 and SE15 in FIG. 16 are performed and then the process flow goes to step SE16. The processes of steps SE14 to SE15 correspond to steps SA10 to SA11 in FIG. 3 and thus description thereof will not be repeated. In step SE16, it is determined whether an operating heat source machine of which the capability has reached the upper limit and of which the cold/hot water outlet temperature has not reached the compensation temperature is present. When it is determined that an operating heat source machine of which the capability has reached the upper limit and of which the cold/hot water outlet temperature has not reached the compensation temperature ("YES" in step SE16), it is determined whether an operating heat source machine of which the capability is less than the upper limit and of which the cold/hot water outlet temperature has reached the compensation temperature is present (step SE17).

When it is determined that such an operating heat source machine is present ("YES" in step SE17), the compensation temperature $T_{set_ul}$ of the operating heat source machine is calculated using Expressions (8) and (9) (step SE18) and the recalculated compensation temperature $T_{set_ul}$ is set as the cold/hot water outlet setting temperature of the operating heat source machine (step SE19).

When the determination result of step SE16 or SE17 is "NO", the process flow goes to step SE20.

Subsequently, it is determined whether a predetermined amount of time elapses after the cold/hot water outlet setting temperature is finally changed or whether the supply water temperature is in an allowable range set to be close to the calculated compensation temperature $T_{set_u}$ calculated in step SE3 (step SE20). Here, as described above, when the compensation temperature $T_{set_ul}$ is set for the operating heat source machine, it may be determined whether the cold/hot water outlet temperature of the operating heat source machine reaches an allowable range set to be close to the compensation temperature $T_{set_ul}$. When the compensation temperature $T_{set_u}$ is set for all the operating heat source machines ("NO" in steps SE16 and SE17), it may be determined whether the cold/hot water outlet temperatures of the operating heat source machines are in the allowable range set to be close to the compensation temperature $T_{set_u}$.

When this condition is not satisfied ("NO" in step SE20), the process flow is returned to step SE16 and the subsequent processes are repeated. Accordingly, in order to distribute the lack heat quantity to the heat source machines with a capability margin, the cold/hot water outlet setting temperature of the operating heat source machine not having reached the capability upper limit is updated every time.

When it is determined that the predetermined amount of time elapses after the cold/hot water outlet setting temperature is finally changed or that the supply water temperature is in the allowable range ("YES" in step SE20), a subtraction instruction is output to the heat source machine to be subtracted (step SE21 in FIG. 17) and then the processes of steps SE22 to SE23 are performed. The processes of steps SE22 to SE23 correspond to steps SA14 to SA15 in FIG. 3 and thus description thereof will not be repeated.

As described above, in the heat source system according to this embodiment and the control method thereof, at the time of adding or subtracting a heat source machine, when the cold/hot water outlet setting temperatures of the operating heat source machines are changed to the compensation temperature and an operating heat source machine which cannot track the compensation temperature due to the capability shortfall thereof is present, the capability shortfall can be supplemented with the operating heat source machines not having reached the capability upper limit. Accordingly, it is possible to effectively use the capability of the operating heat source machines.

Tenth Embodiment

A heat source system according to a tenth embodiment of the present invention and a control method thereof will be described below with reference to the accompanying drawings.

In the first embodiment, for example, at the time of adding a heat source machine, the cold/hot water outlet temperature of the heat source machine to be added is considered to be the return water temperature (the cold/hot water inlet temperature) and the compensation temperature is calculated. However, since the heat source machine to be added gradually exercises the heat source capability after being started, the cold/hot water outlet temperature thereof becomes slowly different from the cold/hot water inlet temperature (return water temperature).

Accordingly, since a heat quantity other than anticipated is sent out from the added heat source machine, it is difficult to keep the supply water temperature close to the target supply water temperature. For example, when the heat source system cools a heat medium, the cold/hot water outlet temperature is set to a temperature lower than the cold/hot water inlet temperature of the heat source machine to be added and the heat medium is supplied. Accordingly, the supply water temperature may be much lower than the target supply water temperature.

Accordingly, in this embodiment, only at the time of adding a heat source machine, the compensation temperature of each operating heat source machine is calculated in consideration of the cold/hot water outlet temperature of the heat source machine to be added after the heat source machine is added.

Specifically, after a heat source machine to be added is added and the cold/hot water pump of the heat source machine is started, the compensation temperature is calculated using the measured value of the cold/hot water outlet temperature instead of the return water temperature. The calculation expression of the compensation temperature is given by Expression (10). The compensation temperature is used as the cold/hot water outlet setting temperatures of the operating heat source machines (the operating heat source machines except the added heat source machine) after the heat source machine to be added is started.

$$T_{set_u} = \frac{T_{set}\left(\sum_{i=1}^{n-1} f_i + f_{n_min}\right) - f_{n_min} \times t_{wout(n)}}{\sum_{i=1}^{n-1} f_i} \tag{10}$$

In Expression (10), $t_{wout(n)}$ represents the cold/hot water outlet temperature of the heat source machine to be added.

Instead of the aforementioned method, for example, the return water temperature and the measured value of the cold/hot water outlet temperature of the heat source machine to be added may be compared and the compensation temperature may be calculated using the lower temperature. In this case, the calculation expression of the compensation temperature is given by Expression (11). Expression (11) represents a case in which the heat source system cools a heat medium and is to calculate the compensation temperature using the higher temperature when the heat source system heats the heat medium.

$$T_{set_u} = \frac{T_{set}\left(\sum_{i=1}^{n-1} f_i + f_{n_min}\right) - f_{n_min} \times \mathrm{Min}(T_{ave_r}, t_{wout(n)})}{\sum_{i=1}^{n-1} f_i} \tag{11}$$

In this way, since the compensation temperatures of the operating heat source machines are calculated in consideration of the change in the cold/hot water outlet temperature of the heat source machine to be added after the heat source machine to be added is started, it is possible to control the supply water temperature so as to be close to the target supply water temperature even while the heat source machine to be added gradually exercises its capability.

Eleventh Embodiment

A heat source system according to an eleventh embodiment of the present invention and a control method thereof will be described below.

In the first embodiment, for example, at the time of adding a heat source machine, the compensation temperature is calculated by considering the cold/hot water outlet temperature of the heat source machine to be added as the return water temperature (cold/hot water inlet temperature). However, the cold/hot water in the stopped heat source machine may not reach the return water temperature because the cold/hot water pump is stopped. For example, in the midsummer, there is a possibility that the temperature of the cold/hot water in the stopped heat source machine will be much higher than the return water temperature. In this case, the cold/hot water having a temperature other than the anticipated temperature is sent out from the added heat source machine and it is difficult to keep the supply water temperature close to the target supply water temperature.

Therefore, in this embodiment, the temperature of the cold/hot water in the heat source machine to be added, for example, the cold/hot water outlet temperature or the cold/hot water inlet temperature of the heat source machine to be added is measured by the temperature sensor and the compensation temperature using the sensor-measured value instead of the return water temperature.

For example, the compensation temperature is calculated by Expression (12).

$$T_{set_u} = \frac{T_{set}\left(\sum_{i=1}^{n-1} f_i + f_n\right) - f_n \times t_n}{\sum_{i=1}^{n-1} f_i} \tag{12}$$

In Expression (12), $T_{set_u}$ represents the cold/hot water outlet setting temperature (—compensation temperature) of an operating heat source machine, $T_{set}$ represents the target supply water temperature, and $f_i$ represents the flow rate of cold/hot water flowing in an operating heat source machine, where $f_{i_max}$ is used as $f_i$, for example, when the setting flow rate of the operating heat source machine is changed to the maximum flow rate as in the third embodiment. $f_n$ represents the flow rate of a heat source machine to be added (hereinafter, referred to as "added heat source machine") and employs, for example, the flow rate set at the time of starting the added heat source machine. $t_n$ represents the temperature of the cold/hot water of the added heat source machine and is set, for example, to the heat source machine inlet temperature or the heat source machine outlet temperature measured by the temperature sensor, $t_n$ may employ any one of the air temperature, the air wet-bulb temperature, and the saturated temperature of the added heat source machine (which may be the saturated temperature determined from the inside pressure) before starting the added heat source machine.

In this way, according to this embodiment, the heat source machine inlet temperature or the heat source machine outlet temperature of the added heat source machine is measured by the temperature sensor and the compensation temperature is calculated using the sensor-measured value instead of the return water temperature. Accordingly, even when the temperature of the cold/hot water in the added heat source machine is separated from the return water temperature, it is possible to keep the supply water temperature close to the target temperature.

Twelfth Embodiment

A heat source system according to a twelfth embodiment of the present invention and a control method thereof will be described below.

For example, in the eleventh embodiment, the influence to the return water temperature is great depending on the temperature of the cold/hot water in the stopped heat source machine, the capability exercitation of the operating heat source machines is not tracked, and it is thus difficult to keep the supply water temperature close to the target temperature.

Therefore, in this embodiment, by setting the flow rate of cold/hot water flowing out of the added heat source machine to be as low as possible before the added heat source machine is started, the influence which the cold/hot water sent out from the added heat source machine gives to the supply water temperature and the return water temperature is decreased.

Figure 18:
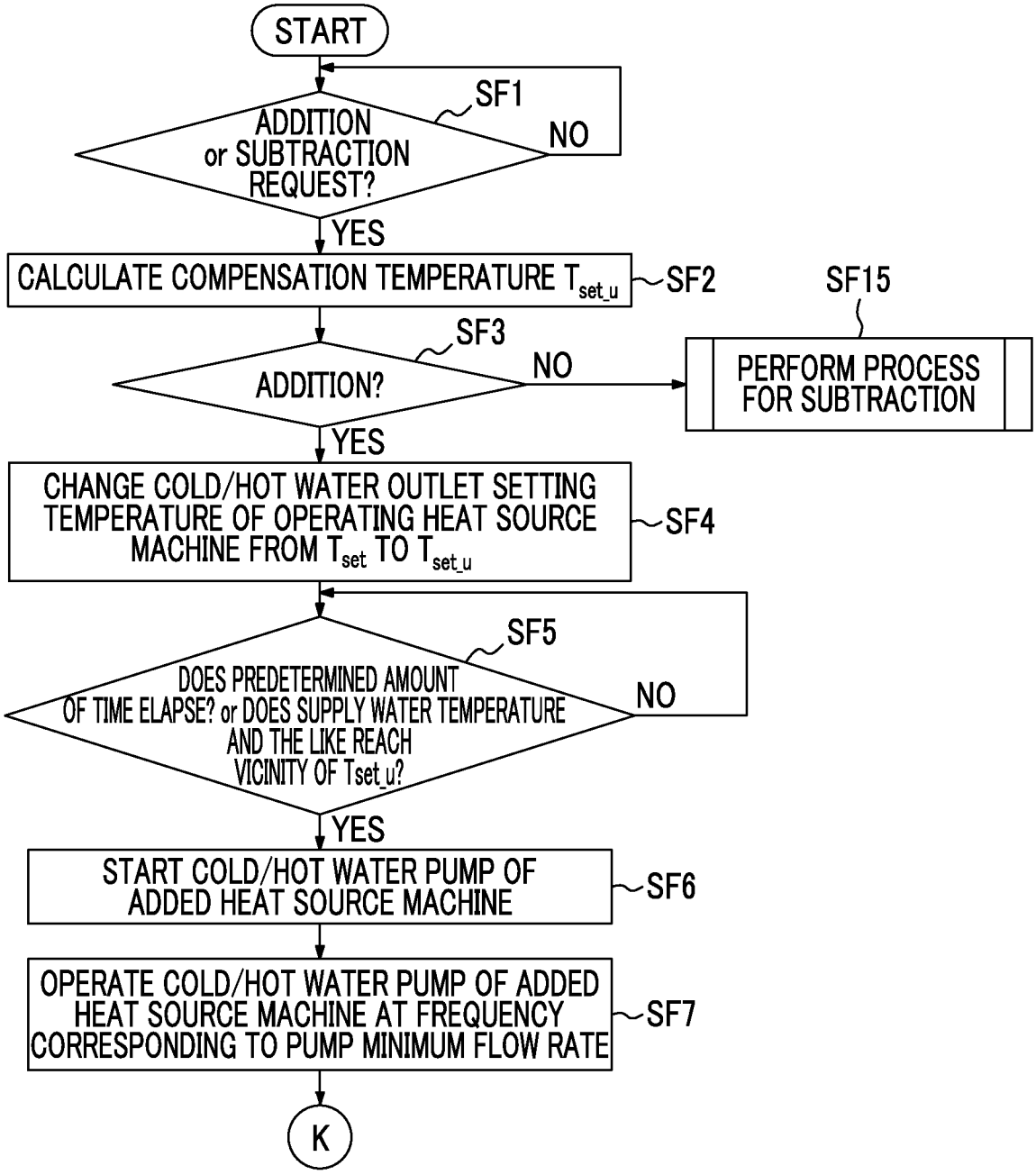
FIG. 18 is a flowchart illustrating an example of a supply water temperature compensating process according to a twelfth embodiment of the present invention.
Figure 19:
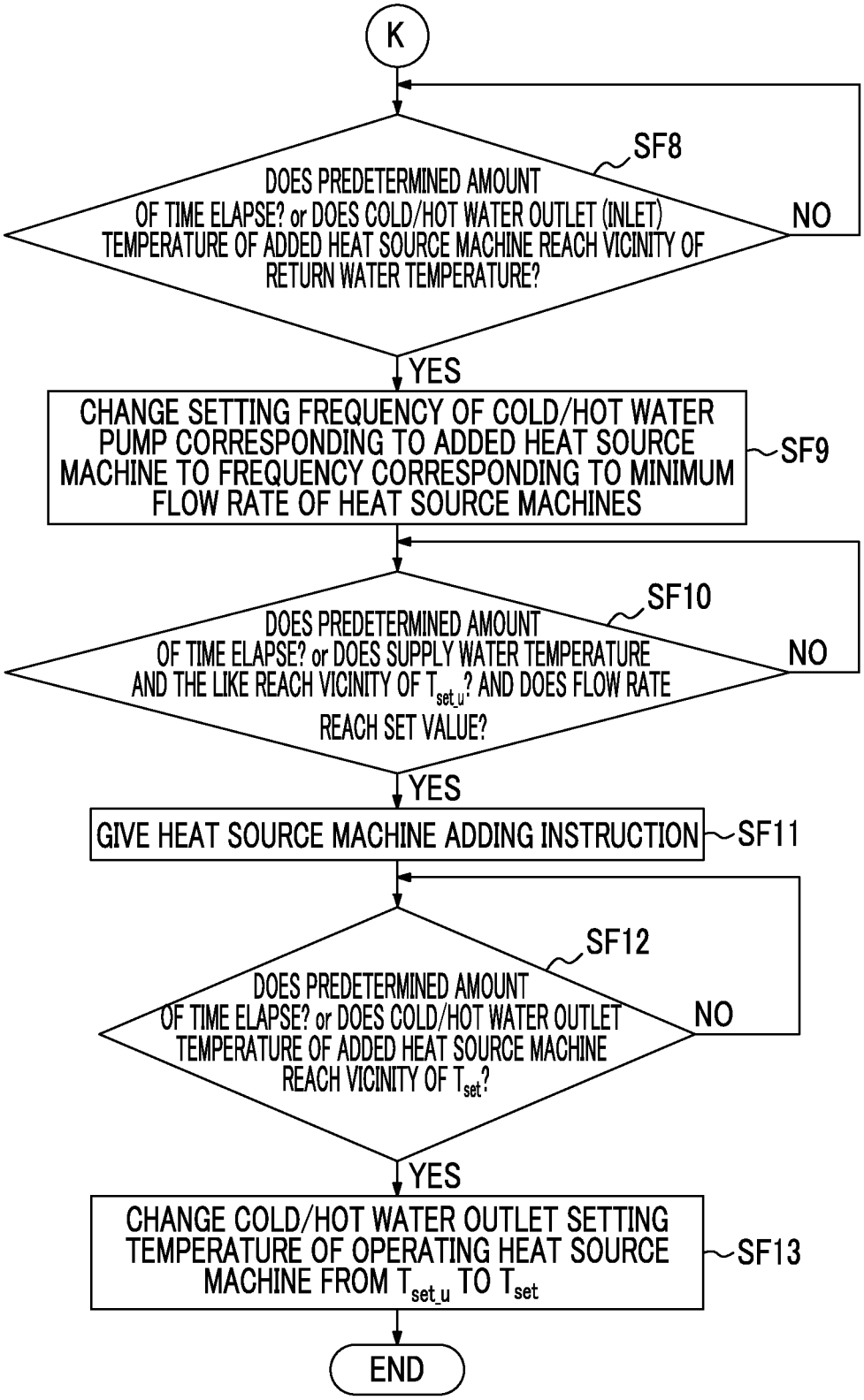
FIG. 19 is a flowchart illustrating an example of the supply water temperature compensating process according to the twelfth embodiment of the present invention.

An example of a supply water temperature compensating process according to this embodiment will be described below with reference to FIGS. 18 and 19.

First, when an addition or subtraction request is input ("YES" in step SF1 in FIG. 18), the compensation temperature is calculated (step SF2). For example, Expression (13) can be used to calculate the compensation temperature.

$$T_{set_u} = \frac{T_{set}\left(\sum_{i=1}^{n-1} f_i + f_n\right) - f_n \times t_n}{\sum_{i=1}^{n-1} f_i} \tag{13}$$

In Expression (13), $T_{set_u}$ represents the cold/hot water outlet setting temperature (—compensation temperature) of an operating heat source machine, $T_{set}$ represents the target supply water temperature, and $f_i$ represents the flow rate of cold/hot water flowing in an operating heat source machine, where $f_{i_max}$ is used as $f_i$, for example, when the setting flow rate of the operating heat source machine is changed to the maximum flow rate as in the third embodiment, $f_n$ represents the flow rate of a heat source machine to be added (hereinafter, referred to as "added heat source machine") and employs, for example, the flow rate of the pump before starting the added heat source machine and the minimum flow rate of the added heat source machine after starting the added heat source machine. $t_n$ represents the temperature of the cold/hot water of the added heat source machine and is set, for example, to the heat source machine inlet temperature or the heat source machine outlet temperature measured by the temperature sensor. $t_n$ may employ any one of the air temperature, the air wet-bulb temperature, and the saturated temperature of the added heat source machine (which may be the saturated temperature determined from the inside pressure) before starting the added heat source machine.

Subsequently, it is determined whether a heat source machine is added (step SF3). When it is determined that a heat source machine is added ("YES" in step SF3), the cold/hot water outlet setting temperatures of the operating heat source machines are changed from the target supply water temperature $T_{set}$ to the compensation temperature $T_{set_u}$ (step SF4).

Subsequently, it is determined whether a predetermined amount of time elapses after the cold/hot water outlet setting temperatures of the heat source machines are changed to the compensation temperature or whether the supply water temperature or the cold/hot water outlet temperatures of the started heat source machines are in an allowable range set to be close to the compensation temperature $T_{set_u}$ (in step SF5). When it is determined that the predetermined amount of time elapses or that the supply water temperature or the cold/hot water outlet temperatures of the started heat source machines are in the allowable range ("YES" in step SF5), a start instruction is output to the cold/hot water pump corresponding to the added heat source machine and the frequency of the cold/hot water pump is set to the frequency corresponding to the minimum flow rate of the pump (steps SF6 and SF7).

Subsequently, it is determined whether a predetermined amount of time elapses after starting the cold/hot water pump or whether the cold/hot water outlet (inlet) temperature of the added heat source machine is in an allowable range set to be close to the return water temperature (step SF8 in FIG. 19). When it is determined that the predetermined amount of time elapses or whether the cold/hot water outlet (inlet) temperature is in the allowable range ("YES" in step SF8), the setting frequency of the cold/hot water pump corresponding to the added heat source machine is changed to the frequency corresponding to the minimum flow rate of the pump (step SF9).

Subsequently, it is determined whether a predetermined amount of time elapses after the setting frequency of the cold/hot water pump is changed or whether the supply water temperature or the cold/hot water outlet temperatures of the operating heat source machines are in an allowable range set to be close to the compensation temperature $T_{set_u}$ and whether the flow rate of the cold/hot water pump reaches the heat source machine minimum flow rate. When it is determined that the predetermined amount of time elapses or that the supply water temperature or the cold/hot water outlet temperatures of the operating heat source machines are in the allowable range and that the flow rate reaches the heat source machine minimum flow rate ("YES" in step SF10), a start instruction is output to the added heat source machine (step SF11).

When it is determined that the predetermined amount of time elapses after starting the heat source machine or that the cold/hot water outlet temperature of the started heat source machine is in the allowable range set to be close to the target supply water temperature $T_{set}$ ("YES" in step SF12), the cold/hot water outlet setting temperatures of the operating heat source machines are changed from the compensation temperature $T_{set_u}$ to the target supply water temperature $T_{set}$ (step SF13) and then the supply water temperature compensating process ends.

When it is determined in step SF3 that a heat source machine is subtracted, the process flow goes to step SF15 and the subtraction control according to any one of the aforementioned embodiments is performed.

As described above, in the heat source system according to this embodiment and the control method thereof, the cold/hot water flow rate of the heat source machine to be added is set to be as small as possible before starting the heat source machine to be added, and is then raised to the minimum flow rate of the heat source machine to be added. Specifically, at the time of adding a heat source machine, the cold/hot water pump corresponding to the added heat source machine is operated at the frequency (the frequency corresponding to the minimum flow rate of the cold/hot water pump) corresponding to the flow rate lower than the minimum flow rate of the heat source machines, the added heat source machine is started on the basis of the relationship of the supply water temperature and the like, and the setting frequency of the cold/hot water pump is changed to the frequency corresponding to the minimum flow rate of the added heat source.

In this way, by operating the cold/hot water pumps in a bundle before starting the added heat source machine, it is possible to supply the cold/hot water in the added heat source at a low flow rate and it is thus possible to reduce the influence of the cold/hot water of the added heat source on the supply water temperature in comparison with the other embodiments. Accordingly, for example, even when the temperature of the cold/hot water in the stopped heat source machine is separated from the return water temperature, it is possible to reduce the variation in the supply water temperature due thereto.

The setting of the flow rate of the added heat source machine is not limited to two steps as described above, but may be performed in two or more steps, for example, continuously from the minimum flow rate of the cold/hot water pump to the heat source machine minimum flow rate.

Thirteenth Embodiment

A heat source system according to a thirteenth embodiment of the present invention and a control method thereof will be described below.

As illustrated in FIG. 1, in the heat source system 1 in which plural heat source machines 10*a*, 10*b*, and 10*c* are connected in parallel, the influences which the supply water from the heat source machines gives to the supply water temperature may be different from each other in construction of pipes. For example, when a heat source machine disposed in the vicinity of the supply header 5 and a heat source machine disposed in the vicinity of the bypass pipe 6 are present, the supply water from the heat source machine disposed in the vicinity of the supply header 5 gives a greater influence to the supply water temperature than the supply water from the heat source machine disposed in the vicinity of the bypass pipe 6.

Therefore, in this embodiment, the compensation temperature $T_{set_u}$ is calculated in consideration of the influences which the supply water of the heat source machines gives to the supply water temperature. Specifically, the influences which the supply water of the heat source machines gives to the supply water temperature are converted into weighting coefficients and are multiplied by the cold/hot water flow rates of the heat source machines.

For example, an expression in which the weighting coefficients are applied to Expression (3) as an expression for calculating the compensation temperature in the first embodiment is expressed by Expression (14).

$$T_{set_u} = \frac{T_{set}\left(\sum_{i=1}^{n-1}(\gamma_i + f_i) + \gamma \times f_{n_min}\right) - \gamma_n \times f_{n_min} \times t_{ave_r}}{\sum_{i=1}^{n-1}(\gamma_i \times f_i)} \tag{14}$$

Here, without being limited to the first embodiment, the weighting may be considered in the calculation expressions for the compensation temperature according to the embodiments.

In the heat source system according to this embodiment and the control method thereof, since the compensation temperature is calculated in consideration of the influence which the supply water of each heat source machine gives to the supply water temperature, it is possible to improve the calculation accuracy of the compensation temperature.

While the embodiments of the present invention have been described, the present invention is not limited to the aforementioned embodiments, but can be modified in various forms by partially or overall combining the aforementioned embodiments without departing from the gist of the present invention.

REFERENCE SIGNS LIST

1: heat source system
2: external load
3*a*, 3*b*, 3*c*: cold/hot water pump
4: return head
5: supply head
6: bypass pipe
7: bypass valve
10*a*, 10*b*, 10*c*: heat source machine
20: upper-level controller

The invention claimed is:

1. A heat source system that includes a plurality of heat source machines connected in parallel to a load and a plurality of water pumps provided to correspond to the plurality of heat source machines, respectively, and that controls operations of the plurality of heat source machines such that a supply water temperature of water which is supplied to the load corresponds to a target supply water temperature which is determined by a load-side request, the heat source system comprising:

a temperature calculator that, when a request of increasing the number of the heat source machines operating is input, anticipates a case in which a predetermined flow rate is set for one or more of the plurality of heat source machines to be added before starting the one or more of the plurality of heat source machines to be added and the water pump corresponding to the one or more of the plurality of heat source machines to be added, and that calculates a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and a temperature setter that determines whether the one or more of the plurality of heat source machines is needed to start operating according to the request of increasing the number of the heat source machines operating, and that changes a water outlet setting temperature of the heat source machine in operation to the compensation temperature when the one or more of the plurality of heat source machines is needed to start operating, wherein one or more of the plurality of heat source machines to be added and a water pump corresponding to the one or more of the plurality of heat source machines to be added are started and a setting flow rate of one or more of the plurality of heat source machines to be added is set to the predetermined flow rate, when a predetermined amount of time elapses after the water outlet setting temperature of the heat source machine in operation is changed to the compensation temperature or when the supply water temperature is in an allowable range set to be close to the compensation temperature.

2. The heat source system according to claim 1, wherein the predetermined flow rate of the one or more of the plurality of heat source machines to be added is set within a range equal to or higher than a minimum flow rate of the water pump provided to correspond to the one or more of the plurality of heat source machines to be added and equal to or lower than a minimum flow rate determined on the basis of a specification of the one or more of the plurality of heat source machines to be added.

3. The heat source system according to claim 1, wherein it is determined whether an operation state of the heat source machine in operation reaches a capability upper limit after at least the water outlet setting temperature of the heat source machine in operation is set to the compensation temperature, and the one or more of the plurality of heat source machine to be added is immediately started when the operation state of the heat source machine in operation reaches the capability upper limit.

4. The heat source system according to claim 1, wherein the compensation temperature is recalculated so as to distribute a heat quantity shortfall of the heat source machines to the other heat source machines in operation of which the capability does not reach the capability upper limit and the water outlet setting temperature of the other heat source machines in operation of which the capability does not reach the capability upper limit is set to the recalculated compensation temperature when the operation states of some heat source machines in operation reach the capability upper limit and the water outlet temperature of the heat source machines in operation does not reach the compensation temperature after the water outlet setting temperature of at least the heat source machines in operation is set to the compensation temperature.

5. The heat source system according to claim 1, wherein the temperature calculator calculates a theoretical value of the return water temperature from the load on the basis of a relationship among a heat source load, a heat quantity of water sent out from the system to the load, and a heat quantity of water flowing into the system, and calculates the compensation temperature using the theoretical value of the return water temperature as the return water temperature.

6. The heat source system according to claim 1, further comprising a temperature sensor configured to measure the return water temperature from the load, wherein the temperature calculator calculates a theoretical value of the return water temperature on the basis of a relationship among a heat source load, a heat quantity of water sent out from the system to the load, and a heat quantity of water flowing into the system, and calculates the compensation temperature using the return water temperature, which is calculated using both the measured value of the return water temperature measured by the temperature sensor and the theoretical value of the return water temperature.

7. The heat source system according to claim 6, wherein the temperature calculator calculates the compensation temperature using a correction value obtained by multiplying a predetermined coefficient equal to or greater than zero and equal to or less than 1 by a value, which is obtained by subtracting theoretical value of the return water temperature from the measured value of the return water temperature measured by the temperature sensor.

8. The heat source system according to claim 1, wherein the temperature calculator calculates the compensation temperature using the water outlet temperature of the heat source machines in operation, or the lower temperature of the water outlet temperature and the return water temperature when cooling water, or the higher temperature of the water outlet temperature and the return water temperature when heating water as the return water temperature after the one or more of the plurality of heat source machines to be added is started.

9. A heat source system that includes a plurality of heat source machines connected in parallel to a load and a plurality of water pumps provided to correspond to the plurality of heat source machines, respectively, and that controls operations of the plurality of heat source machines such that a supply water temperature of water which is supplied to the load corresponds to a target supply water temperature which is determined by a load-side request, the heat source system comprising:

a temperature calculator that, when a request of decreasing the number of the heat source machines operating is input, anticipates a case in which a predetermined flow rate is set for one or more of the plurality of heat source machines to be subtracted before stopping the one or more of the plurality of heat source machines to be subtracted and the water pump corresponding to the one or more of the plurality of heat source machines to be subtracted, and that calculates a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and a temperature setter that determines whether the one or more of the plurality of heat source machines is needed to stop operating according to the request of decreasing the number of the heat source machines operating, and that changes a water outlet setting temperature of the heat source machine in operation to the compensation temperature when the one or more of the plurality of heat source machines is needed to stop operating, wherein the one or more of the plurality of heat source machines to be subtracted is stopped and the water pump corresponding to the one or more of the plurality of heat source machines to be subtracted is stopped, when a predetermined amount of time elapses after the water outlet setting temperature of the heat source machine in operation is changed to the compensation temperature or when the supply water temperature or the water outlet temperature of the heat source machine in operation is in an allowable range set to be close to the compensation temperature.

10. The heat source system according to claim 9, wherein the predetermined flow rate of the one or more of the plurality of heat source machines to be subtracted is set to a minimum flow rate determined on the basis of a specification of the one or more of the plurality of heat source machines.

11. The heat source system according to claim 9, wherein the compensation temperature is recalculated so as to distribute a heat quantity shortfall of the heat source machines to the other heat source machines in operation of which the capability does not reach the capability upper limit and the water outlet setting temperature of the other heat source machines in operation of which the capability does not reach the capability upper limit is set to the recalculated compensation temperature when the operation states of some heat source machines in operation reach the capability upper limit and the water outlet temperature of the heat source machines in operation does not reach the compensation temperature after the water outlet setting temperature of at least the heat source machines in operation is set to the compensation temperature.

12. The heat source system according to claim 9, wherein the temperature calculator calculates a theoretical value of the return water temperature from the load on the basis of a relationship among a heat source load, a heat quantity of water sent out from the system to the load, and a heat quantity of water flowing into the system, and calculates the compensation temperature using the theoretical value of the return water temperature as the return water temperature.

13. The heat source system according to claim 9, further comprising a temperature sensor configured to measure the return water temperature from the load, wherein the temperature calculator calculates a theoretical value of the return water temperature on the basis of a relationship among a heat source load, a heat quantity of water sent out from the system to the load, and a heat quantity of water flowing into the system, and calculates the compensation temperature using the return water temperature, which is calculated using both the measured value of the return water temperature measured by the temperature sensor and the theoretical value of the return water temperature.

14. The heat source system according to claim 13, wherein the temperature calculator calculates the compensation temperature using a correction value obtained by multiplying a predetermined coefficient equal to or greater than zero and equal to or less than 1 by a value, which is obtained by subtracting theoretical value of the return water temperature from the measured value of the return water temperature measured by the temperature sensor.

15. The heat source system according to claim 9, wherein the temperature calculator calculates the compensation temperature using the water outlet temperature of the heat source machines in operation, or the lower temperature of the water outlet temperature and the return water temperature when cooling water, or the higher temperature of the water outlet temperature and the return water temperature when heating water as the return water temperature after the one or more of the plurality of heat source machines to be subtracted is stopped.

16. A heat source system that includes a plurality of heat source machines connected in parallel to a load and a plurality of water pumps provided to correspond to the plurality of heat source machines, respectively, and that controls operations of the plurality of heat source machines such that a supply water temperature of water which is supplied to the load corresponds to a target supply water temperature which is determined by a load-side request, the heat source system comprising:

a temperature calculator that, when a request of decreasing the number of the heat source machines operating is input, anticipates a case in which a predetermined flow rate is set for one or more of the plurality of heat source machines to be subtracted before stopping the one or more of the plurality of heat source machines to be subtracted and the water pump corresponding to the one or more of the plurality of heat source machines to be subtracted, and that calculates a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and a temperature setter that determines whether the one or more of the plurality of heat source machines is needed to stop operating according to the request of decreasing the number of the heat source machines operating, and that changes a water outlet setting temperature of the heat source machine in operation other than the one or more of the plurality of heat source machines to be subtracted to the compensation temperature when the one or more of the plurality of heat source machines is needed to stop operating, and wherein the one or more of the plurality of heat source machines to be subtracted is stopped and the water pump corresponding to the one or more of the plurality of heat source machines to be subtracted is stopped, when a predetermined amount of time elapses after the water outlet setting temperature of the heat source machine in operation is changed to the compensation temperature or when the water outlet temperature of the heat source machine in operation other than the one or more of the plurality of heat source machines to be subtracted is in an allowable range set to be close to the compensation temperature.

17. A heat source method, in which a plurality of heat source machines connected in parallel to a load and a plurality of water pumps is provided to correspond to the plurality of heat source machines, for controlling operations of the plurality of heat source machines such that a supply water temperature of water which is supplied to the load corresponds to a target supply water temperature which is determined by a load-side request, the heat source method comprising:

calculating a temperature when a request of increasing the number of the heat source machines operating is input;

determining a case in which a predetermined flow rate is set for one or more of the plurality of heat source machines to be added before starting the one or more of the plurality of heat source machines to be added and the water pump corresponding to the one or more of the plurality of heat source machines to be added;

calculating a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and determining whether the one or more of the plurality of heat source machines is needed to start operating according to the request of increasing the number of the heat source machines operating, and changing, a water outlet setting temperature of the heat source machine in operation to the compensation temperature when the one or more of the plurality of heat source machines is needed to start operating, wherein one or more of the plurality of heat source machines to be added and a water pump corresponding to the one or more of the plurality of heat source machines to be added are started and a setting flow rate of one or more of the plurality of heat source machines to be added is set to the predetermined flow rate, when a predetermined amount of time elapses after the water outlet setting temperature of the heat source machine in operation is changed to the compensation temperature or when the supply water temperature is in an allowable range set to be close to the compensation temperature.

18. A heat source method, in which a plurality of heat source machines connected in parallel to a load and a plurality of water pumps is provided to correspond, to the plurality of heat source machines, for controlling operations of the plurality of heat source machines such that a supply water temperature of water which is supplied to the load corresponds to a target supply water temperature which is determined by a load-side request, the heat source method comprising:

calculating a temperature when a request of decreasing the number of the heat source machines operating is input;

determining a case in which a predetermined flow rate is set for one or more of the plurality of heat source machines to be subtracted before stopping the one or more of the plurality of heat source machines to be subtracted and the water pump corresponding to the one or more of the plurality of heat source machines to be subtracted;

calculating a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and determining whether the one or more of the plurality of heat source machines is needed to stop operating according to the request of decreasing the number of the heat source machines operating, and changing a water outlet setting temperature of the heat source machine in operation to the compensation temperature when the one or more of the plurality of heat source machines is needed to stop operating, wherein the one or more of the plurality of heat source machines to be subtracted is stopped and the water pump corresponding to the one or more of the plurality of heat source machines to be subtracted is stopped, when a predetermined amount of time elapses after the water outlet setting temperature of the heat source machine in operation is changed to the compensation temperature or when the supply water temperature or the water outlet temperature of the heat source machine in operation is in an allowable range set to be close to the compensation temperature.

19. A heat source method, in which a plurality of heat source machines connected in parallel to a load and a plurality of water pumps is provided to correspond to the plurality of heat source machines, for controlling operations of the plurality of heat source machines such that a supply water temperature of water which is supplied to the load corresponds to a target supply water temperature which is determined by a load-side request, the heat source method comprising:

calculating a temperature when a request of decreasing the number of the heat source machines operating is input;

determining a case in which a predetermined flow rate is set for one or more of the plurality of heat source machines to be subtracted before stopping the one or more of the plurality of heat source machines to be subtracted and the water pump corresponding to the one or more of the plurality of heat source machines to be subtracted;

calculating a new water outlet temperature of a heat source machine in operation as a compensation temperature such that the supply water temperature corresponds to the target supply water temperature, the compensation temperature being repeatedly calculated with a predetermined sampling cycle on the basis of a flow rate of water flowing in the heat source machine in operation and a return water temperature from the load; and determining whether the one or more of the plurality of heat source machines is needed to stop operating according to the request of decreasing the number of the heat source machines operating, and changing a water outlet setting temperature of the heat source machine in operation other than the one or more of the plurality of heat source machines to be subtracted to the compensation temperature when the one or more of the plurality of heat source machines is needed to stop operating, and wherein the one or more of the plurality of heat source machines to be subtracted is stopped and the water pump corresponding to the one or more of the plurality of heat source machines to be subtracted is stopped, when a predetermined amount of time elapses after the water outlet setting temperature of the heat source machine in operation is changed to the compensation temperature or when the water outlet temperature of the heat source machine in operation other than the one or more of the plurality of heat source machines to be subtracted is in an allowable range set to be close to the compensation temperature.

* * * * *